US009296008B2

(12) United States Patent
Mueller et al.

(10) Patent No.: US 9,296,008 B2
(45) Date of Patent: Mar. 29, 2016

(54) LEVER ARM SUSPENSION FOR USE IN AN ADHESIVE APPLICATION HEAD AND ADHESIVE APPLICATION HEAD WITH LEVER ARM SUSPENSION

(75) Inventors: Heinz Mueller, Gelterkinden (CH); Christoph Kaeppeli, Merenschwand (CH); Felix Huembeli, Muri (CH)

(73) Assignee: ROBATECH AG, Muri (CH)

( * ) Notice: Subject to any disclaimer, the term of this patent is extended or adjusted under 35 U.S.C. 154(b) by 148 days.

(21) Appl. No.: 13/981,854

(22) PCT Filed: Jun. 7, 2011

(86) PCT No.: PCT/EP2011/059397

§ 371 (c)(1),
(2), (4) Date: Nov. 14, 2013

(87) PCT Pub. No.: WO2012/100844

PCT Pub. Date: Aug. 2, 2012

(65) Prior Publication Data

US 2014/0054331 A1 Feb. 27, 2014

(30) Foreign Application Priority Data

Jan. 25, 2011 (DE) ..... 20 2011 000 179 U

(51) Int. Cl.
*B05C 5/02* (2006.01)
*B05C 11/10* (2006.01)

(52) U.S. Cl.
CPC ..... *B05C 5/0229* (2013.01); *B05C 5/0225* (2013.01); *B05C 5/0237* (2013.01); *B05C 11/10* (2013.01)

(58) Field of Classification Search
CPC ..... B05C 5/001; B05C 5/02; B05C 5/0225; B05C 5/0237; F16K 31/10; F16K 11/052; F16K 11/0525; F16K 11/056; F16K 11/0565
USPC ..... 222/504, 146.2, 146.5, 559; 251/129.2, 251/129.17, 298; 137/625.44, 875
See application file for complete search history.

(56) References Cited

U.S. PATENT DOCUMENTS 2,675,508 A * 4/1954 Ray ..... 335/238
2,750,960 A * 6/1956 Hansen et al. ..... 137/864

(Continued)

FOREIGN PATENT DOCUMENTS

EP 1588777 A2 10/2005
WO 9958426 A1 11/1999

*Primary Examiner* — Paul R Durand
*Assistant Examiner* — Charles P Cheyney
(74) *Attorney, Agent, or Firm* — Browdy and Neimark, PLLC

(57) ABSTRACT

An application head for dispensing a flowable medium includes a nozzle chamber in the application head and a nozzle needle movably mounted in the nozzle chamber. A supply channel and a supply line introduce the medium into the nozzle chamber. A drive moves the movable element. A lever arm is movably fastened to the nozzle needle and connected to the drive. The lever arm extends through a membrane of a membrane suspension connect the lever arm movably to the application head and form a seal to prevent escape of the flowable medium. Alternatively, a rocker suspension has a lever arm connectable to the movable element and the drive, a plate element has an opening through which the lever arm extends, a rocker mounting device connects the lever arm movably to the application head and a sealing device prevents any escape of adhesive from the chamber through the plate element opening.

21 Claims, 12 Drawing Sheets

(56) References Cited

U.S. PATENT DOCUMENTS

| | | | | | |
|---|---|---|---|---|---|
| 3,143,131 | A | * | 8/1964 | Spencer | 137/269 |
| 3,570,807 | A | * | 3/1971 | Sturman et al. | 251/65 |
| 3,785,563 | A | * | 1/1974 | Maple | 239/748 |
| 4,085,952 | A | * | 4/1978 | Sharples | 251/298 |
| 4,285,497 | A | * | 8/1981 | Gottel | 251/129.2 |
| 4,582,231 | A | * | 4/1986 | Warning, Jr. | 222/485 |
| 4,986,308 | A | * | 1/1991 | Champseaux | 137/625.44 |
| 5,027,857 | A | * | 7/1991 | Champseix | 137/625.44 |
| 5,314,164 | A | * | 5/1994 | Smith | 251/129.17 |
| 5,772,181 | A | * | 6/1998 | Robertson, III | 251/129.06 |
| 5,954,311 | A | * | 9/1999 | Thorpe | 251/30.03 |
| 6,003,552 | A | * | 12/1999 | Shank et al. | 137/625.44 |
| 6,318,408 | B1 | * | 11/2001 | Fukano et al. | 137/625.44 |
| 2005/0236438 | A1 | * | 10/2005 | Chastine et al. | 222/504 |

* cited by examiner

LEVER ARM SUSPENSION FOR USE IN AN ADHESIVE APPLICATION HEAD AND ADHESIVE APPLICATION HEAD WITH LEVER ARM SUSPENSION

The invention relates to a lever arm suspension for use in an adhesive application head and an adhesive application head with lever arm suspension for dispensing a flowable adhesive. In particular, it relates to the dispensing of adhesives and the use of hot glue. The invention can also be used for the controlled dispensing of cold glue or of glue comprising aggressive (e.g. corrosive) components.

The priority of the Utility Model Application DE202011000179.2, which was filed at the German Patent and Trademark Office on 25 Jan. 2011, is claimed.

BACKGROUND OF THE INVENTION

Prior Art

In numerous industrial treatment processes, adhesives, sealing compounds and similar flowable media are used, which are applied or sprayed in liquid form onto a workpiece or substrate.

The corresponding application heads must be robust and allow precise, highly accurate dispensing of the medium. The application heads should at the same time be rapidly switchable in order to be able to portion out adhesive quantities or apply them precisely in spots or strips. In addition, the application heads should not be excessively large since frequently only limited space is available in the corresponding application devices.

Furthermore, application heads should be flexibly usable and should be capable of being refitted as required or preferably capable of being switched over or monitored at the controller.

Further problems arise if hot glue is to be processed. Thus, for example, the great heat in the interior of an application head can damage the drive unit. There are also types of glue which contain additives, which can be aggressive. The pH of a glue can thus be in the acid range, for example, Glue can also contain corrosively or abrasively acting components. In order to protect an application head from these, suitable measures must betaken.

The object arises of providing a precisely operating and reliable application head which avoids or entirely remedies some of the disadvantages of previously known solutions.

The object is solved by a lever arm suspension according to claim 1 according to one of variants (A) or (B) and by an adhesive application head according to claim 20 having a corresponding lever arm suspension according to one of variants (A) or (B).

A first adhesive application head according to the invention is especially designed for dispensing a flowable medium. It comprises a (nozzle) chamber in the interior of the application head and a nozzle needle, a needle valve or a slide (designated here in summary as a "movable element"), which is mounted movably in the interior of the nozzle chamber. The movable element executes a movement and releases an outlet opening for a short time in each case. The application head can also act in reverse, whereby a valve is used in which a piston rod closes against the flow of a medium. Preferably a supply channel is provided, which is connected to the (nozzle) chamber and is fluidically connectable to a supply line. The flowable medium can be introduced into the (nozzle) chamber through the supply line and the supply channel. A drive generates the opening movement or closing movement of the movable element. A lever arm is provided, whose first extremal end is fastened movably on a rear end of the movable element and whose second extremal end is connected/coupled to the drive.

According to the invention, the adhesive application head comprises a lever arm suspension which is configured according to one of the following variants (A) or (B).

According to variant (A), the lever arm suspension is a membrane suspension with a membrane. The lever arm extends substantially perpendicularly through a surface spanned by the membrane of the membrane suspension. The membrane is used to connect the lever arm movably to the application head. Furthermore, the membrane suspension serves as a seal in order to prevent any escape of the flowable medium from the (nozzle) chamber.

The membrane suspension according to variant (A) comprises a lever arm which can be connected to the movable element and the drive in order to convert a drive-side movement into the opening movement of the movable element, and a membrane which is operatively connected to the lever arm. At the same time, the membrane suspension is designed to connect the lever arm movably to the application head. Furthermore, the membrane of the membrane suspension serves as a seal in order to prevent any escape of the adhesive from the chamber.

In addition, the membrane is preferably designed so that it is resistant to the flowable medium. Preferably in all the embodiments, the membrane is temperature-resistant and/or corrosion-resistant and/or abrasion-resistant and/or resistant to chemical additives in the medium.

In addition, the membrane is preferably designed so that it exhibits a nonlinear movement behaviour.

Depending on the embodiment, the membrane can comprise at least one sealing ring which serves as a seal and for elastic clamping of the membrane in the application head. This embodiment can be used in all embodiments of the invention and affords an improved seal, e.g. with respect to escaping adhesive.

Particularly preferred is an embodiment in which this comprises a metallic membrane which can execute particularly rapid back and forth movements and therefore allows a rapid opening and dosing of the outlet opening. Such a metallic membrane is particularly suitable for alternating load at high frequency, i.e. for embodiments in which a rapid opening or closing is required. A metallic membrane as membrane is particularly advantageous and can be used in all embodiments of the invention. Such a metallic membrane is particularly suitable for high temperatures and pressures. The membrane can have slots in order to increase the elasticity as well as a central opening through which the lever arm runs in the mounted state.

The lever arm and the membrane can be operatively connected to one another so that the membrane suspension in the installed state converts a drive-side movement into an opposite opening movement of the movable element.

Furthermore the membrane can have a support in order to predefine a nonlinear movement behaviour. In this case, the membrane can in particular comprise a support with a pin in order to be able to influence the movement behaviour. The membrane can also comprise a support with a region which is designed to be clamped in or on a housing of the adhesive application head.

According to variant (B) the lever arm suspension is a rocker mounting which comprises the following: a lever arm which can be connected to the movable element and the drive in order to convert a drive-side movement into the opening movement of the movable element, a rocker mounting device which is designed to connect the lever arm movably to the application head and a sealing device which is configured to prevent any escape of adhesive from the chamber through the opening in the plate element. An advantage of the configuration of the lever arm suspension as a rocker mounting according to variant (B) compared with the configuration as membrane suspension according to variant (A) is that the axis of rotation of the lever arm in the rocker mounting is well-defined; as a result, the mounting of the lever arm mounting configured as a rocker mounting in the adhesive application head is simpler.

The rocker mounting device can comprise the following: a rocker element which is rigidly connected to the lever arm and which has a longitudinal direction and a first and second mounting point, where the longitudinal direction extends substantially perpendicular to the lever arm and in a plane parallel to the plate element and where the first and the second mounting point are disposed spaced apart in the longitudinal direction, and furthermore a first and second support device which are disposed on a rocker bearing side of the plate element and which are configured to support the first or second bearing point.

The first and the second support device can be configured as a first and a second ball. In this case, the plate element can have a first and a second recess on the rocker bearing side thereof, which are each configured as a ball seat on the plate element side, and on its side facing the plate element the rocker element can have a first and a second recess, each configured as a ball seat on the rocker element side. Advantages of the configuration of the rocker mounting by means of two balls are that the adhesive pressure is absorbed via the balls and that the force always remains the same during the deflection of the lever arm in contrast to the situation in the membrane which has no linear or constant spring constant.

In a first further development to this end, the diameter of each recess on the plate element side can be greater, possibly about 0.1 mm greater, than the diameter of the ball, so that during operation of the adhesive application head the ball can rest on an adhesive film in the recess on the plate element side. Furthermore, the first or second ball can be pressed in the first or second ball seat on the rocker element side.

In an alternative second further development to this end, the diameter of each recess on the rocker element side can be greater, possibly about 0.1 mm greater, than the diameter of the ball so that during operation of the adhesive application head the ball can rest on an adhesive film in the recess on the rocker element side. Furthermore, the first or second ball can be pressed in the first or second ball seat on the plate element side.

The sealing ring can comprise an O ring which is disposed around the opening on the side of the rocker element. In one embodiment for this, the plate element can have a plate-element-side O ring seat surrounding the opening on the side of the rocker element and the rocker element can have a corresponding rocker-element-side O ring seat on its side facing the plate element. In particular, the plate-element-side O ring seat can be configured as a flange formed on the rocker-element-side outlet of the opening, and formed around the opening, having a first contact surface parallel to the plate element plane and a cylindrical inner-wall-shaped second contact surface for supporting an outer circumference of the O ring, and the rocker-element-side O ring seat can be configured as a flange formed on the side of the rocker element facing the plate element, having a first contact surface parallel to the plate element plane and a cylindrical outer-wall-shaped second contact surface for supporting an inner circumference of the O ring. Should this be necessary, in the case of larger stroke movements of the movable element and correspondingly larger deflections of the lever arm, the sealing ring configured as an O ring can be replaced by a special seal, possibly in the manner of a sleeve. A first advantage of the configuration of the sealing ring as an O ring is that in this way a standard element (O ring) can be used. A second advantage is obtained from the following observation. In the case of a lever arm suspension configured as a membrane suspension in which the sealing of the pressure chamber with respect to the outside space is formed only by the membrane itself, in the event of a rupture of the membrane an abrupt massive leakage or escape of adhesive from the chamber into the outside space can occur. In contrast to this, in a configuration of the lever arm suspension as a rocker mounting, no such abrupt leakage can occur.

The rocker mounting can further comprise a spring element which pretensions the rocker element in the direction of the plate element and the mounting points. In this case, the spring element can in particular be a spiral spring which is disposed on the side of the plate element opposite the rocker mounting side around the lever arm. At the same time, on its side opposite the rocker bearing side the plate element can have a plate-side seat for the spring element disposed around the opening, and at its outer drive-side end the lever arm can have a lever-arm-side seat for the spring element configured as a flange.

The lever arm can be configured to be two-part and comprise, on the rocker bearing side, a first sub-arm which can be connected to the movable element and on the side opposite the rocker bearing side, a second sub-arm which can be connected to the drive. In a further development the second sub-arm can comprise the following: a screw nut, a screw rod having a screw nut thread and a screw thread which engages at the outer end thereof in a complementary internal thread in the first sub-arm, and a sleeve which comprises the lever-arm-side seat for the spring element, configured as a flange and through which the screw rod extends.

Regardless of the configuration of the lever arm suspension possibly according to variant (A) or (B), in the adhesive application head the drive and the lever arm suspension can be substantially thermally decoupled from one another by means of a thermal decoupling device and connected to one another in functional interaction.

The thermal decoupling device can comprise an insulation plate which is disposed between the drive and the lever arm suspension and at least two cable tensioning devices which each connect the drive and the lever arm suspension to one another.

The cable tensioning device can comprise a spacer/positioning bolt which is disposed between the drive and the lever arm suspension and a tensioning cable which extends through the spacer/positioning bolt and can be anchored at one end thereof by means of a drive-side anchoring in the drive and at the other end thereof in a lever-arm side anchoring in the lever arm suspension.

The invention is quite particular suitable for thermoplastic (hot melt) adhesives. However, it is also suitable for aggressive types of glue and e.g. for cold glue.

Further details and advantages of the invention are described in detail hereinafter by means of exemplary embodiments and in part with reference to the drawings. All the figures are schematic and not to scale and corresponding constructive elements are provided with the same reference numbers in the different figures even if they are configured differently in detail. In the figures.

Figure 13:
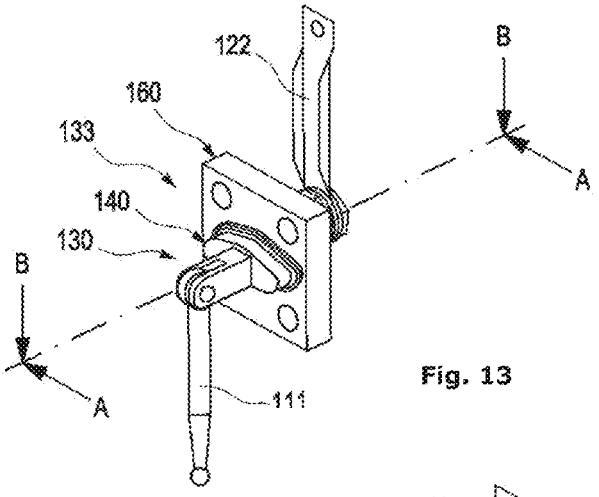
FIG. 13 shows a first perspective view of a further embodiment of the invention according to variant (B)
Figure 14:
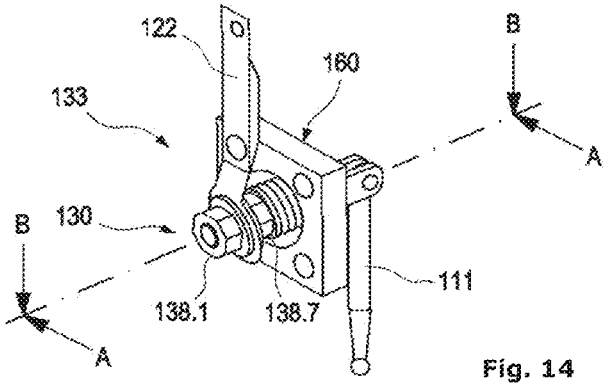
Figure 15:
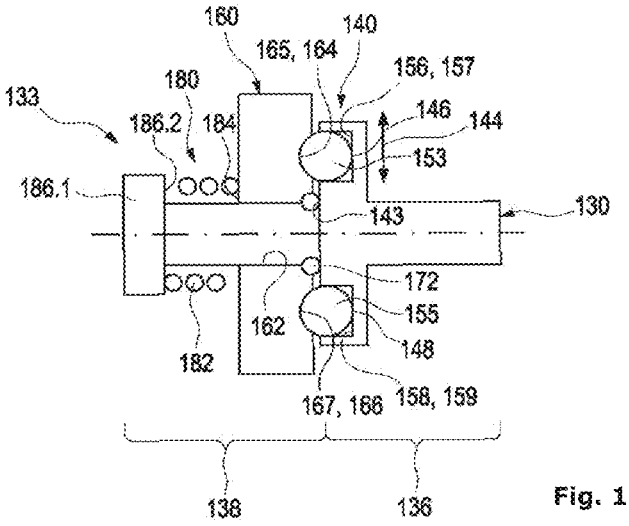
Figure 16A:
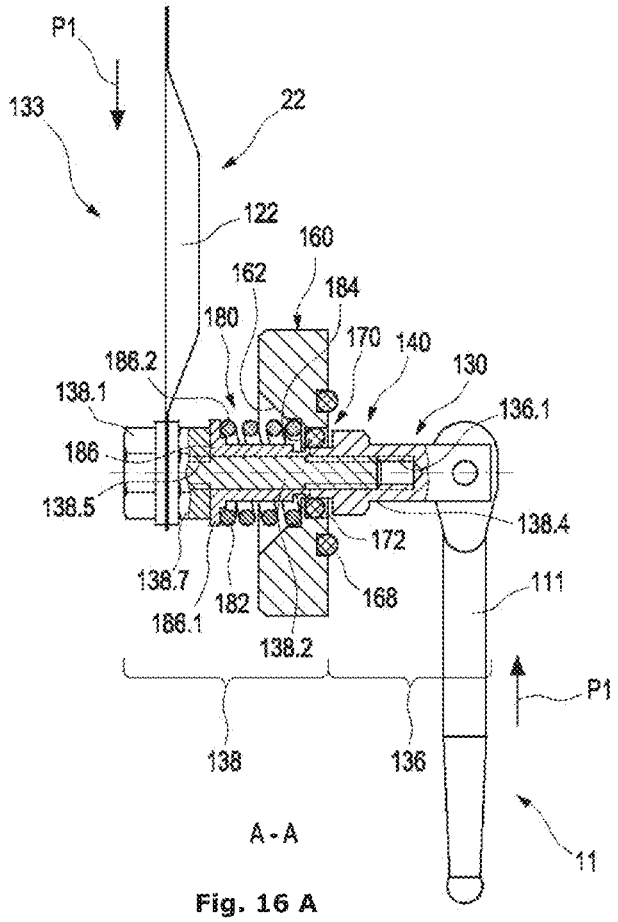
Figure 16B:
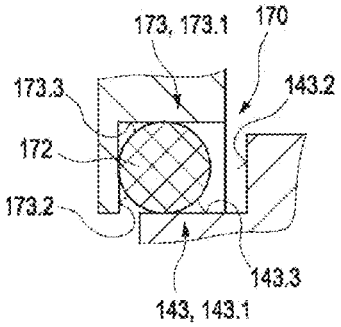
Figure 17:
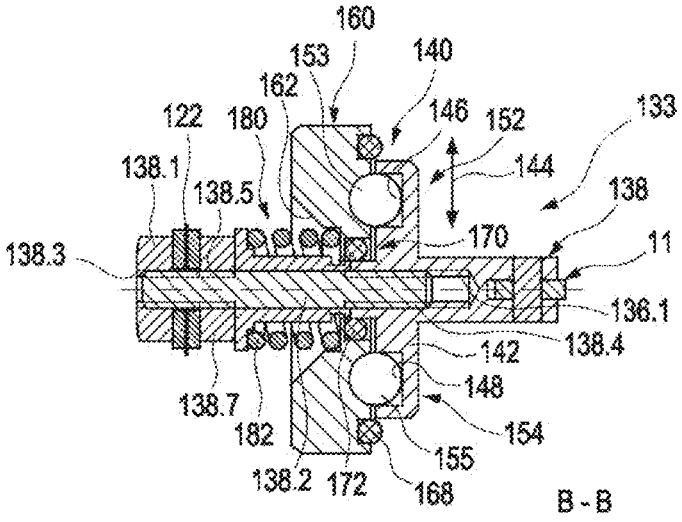
Figure 18A:
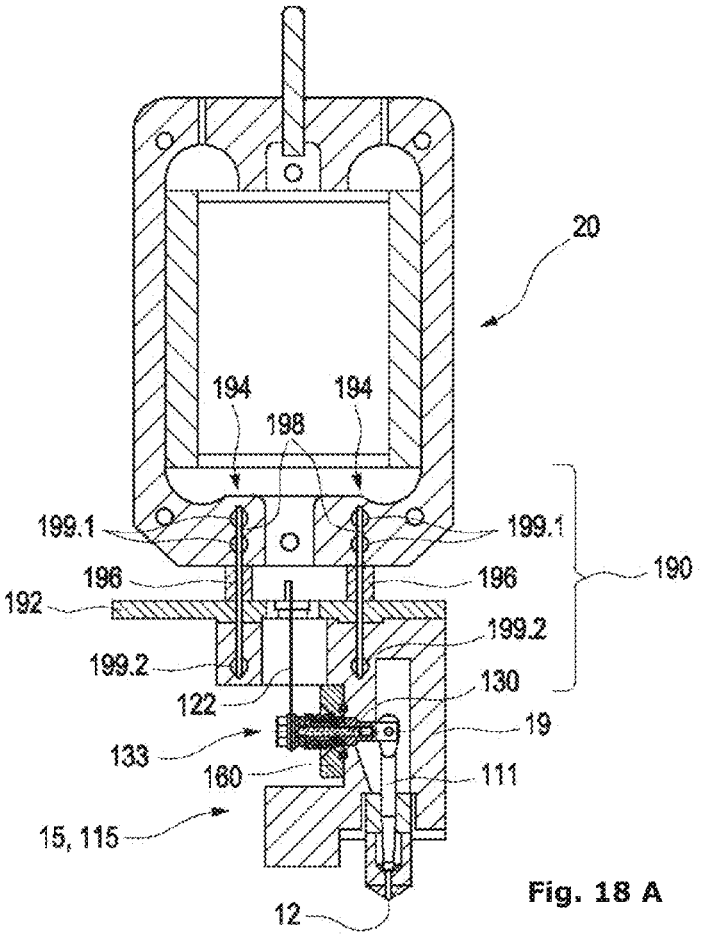
Figure 18B:
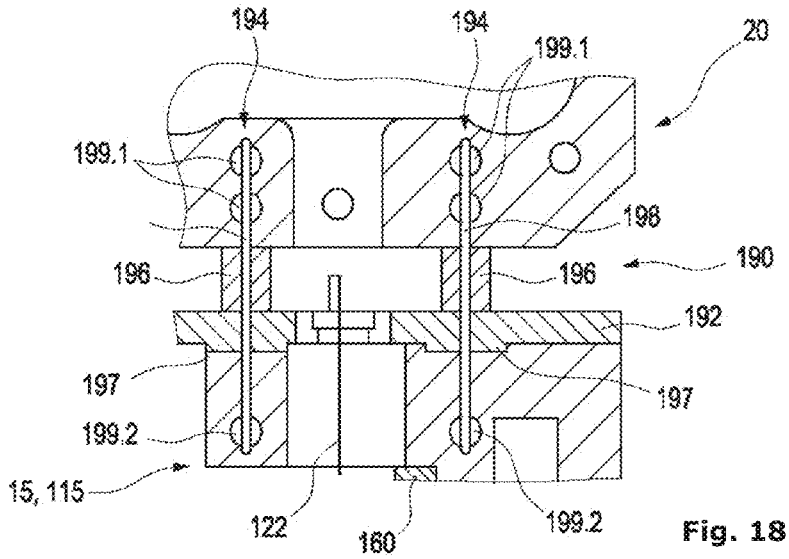

FIG. 14 shows a second perspective view of the embodiment of the invention from FIG. 13 according to variant (B); and FIG. 15 shows a schematic cross-sectional view of a schematic further embodiment of the invention according to variant (B), FIG. 16A shows a side view, partially cutaway along the line A-A in FIGS. 13 and 14 and shown as a cross-section, the embodiment of the invention from FIGS. 13 and 14 according to variant (B);

FIG. 16B shows a detailed view to FIG. 16A;

FIG. 17 shows a cross-sectional view of the embodiment of the invention from FIGS. 13 and 14 according to variant (B), cut away along the line B-B in FIGS. 13 and 14;

FIG. 18A shows a schematic sectional view of a further embodiment of the invention according to variant (B); and FIG. 18B shows a detailed view to FIG. 18A.

DETAILED DESCRIPTION OF THE EXEMPLARY EMBODIMENTS

Figure 1:
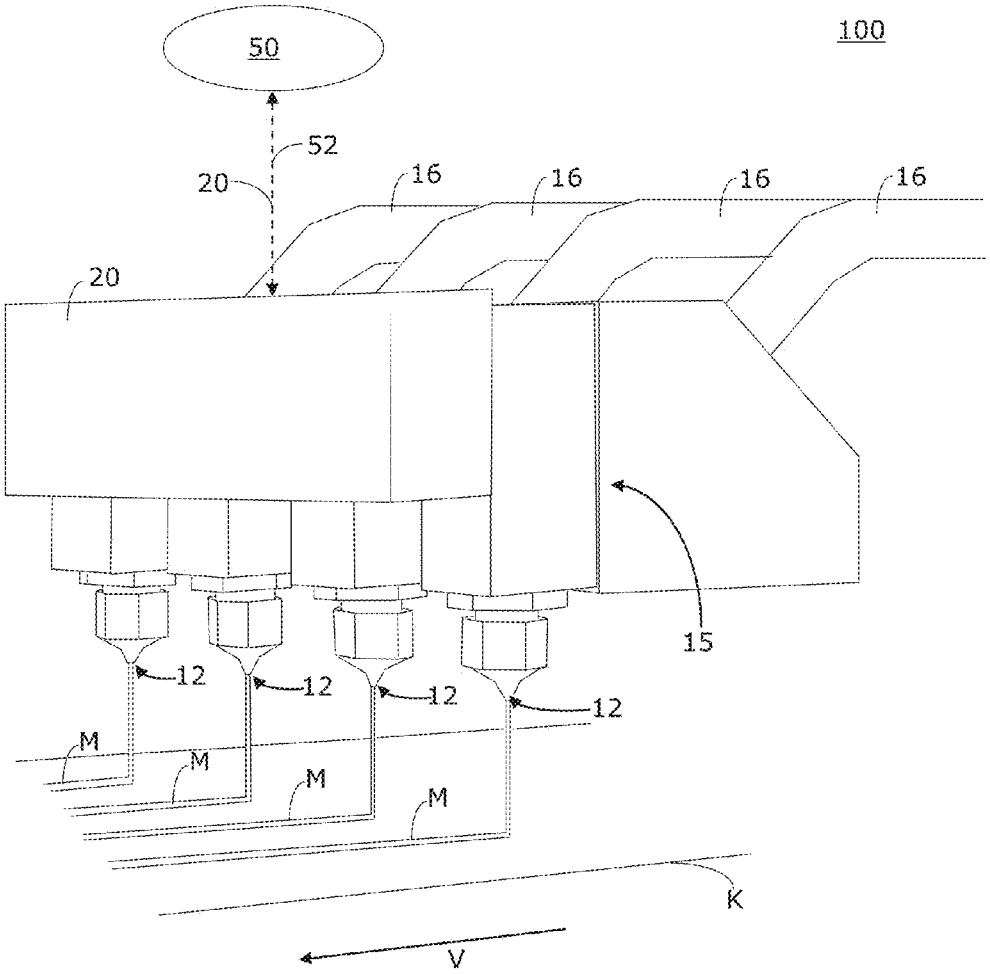
FIG. 1 shows a schematic perspective view of a first embodiment of the invention.

The principle of the invention will be described hereinafter by reference to a first embodiment. FIG. 1 shows an application device 100 having multiple application heads 15 arranged in a row, nozzle outlet openings 12, and having individually switchable adhesive supply lines 16. Instead of the nozzle outlet openings 12 shown, other outlet openings 12 can also be used. The shape, arrangement, and design of the outlet openings 12 can be dependent on whether a nozzle needle, a needle valve, or a slide is used as the movable element 11 in the interior of the application head 15.

Figure 2:
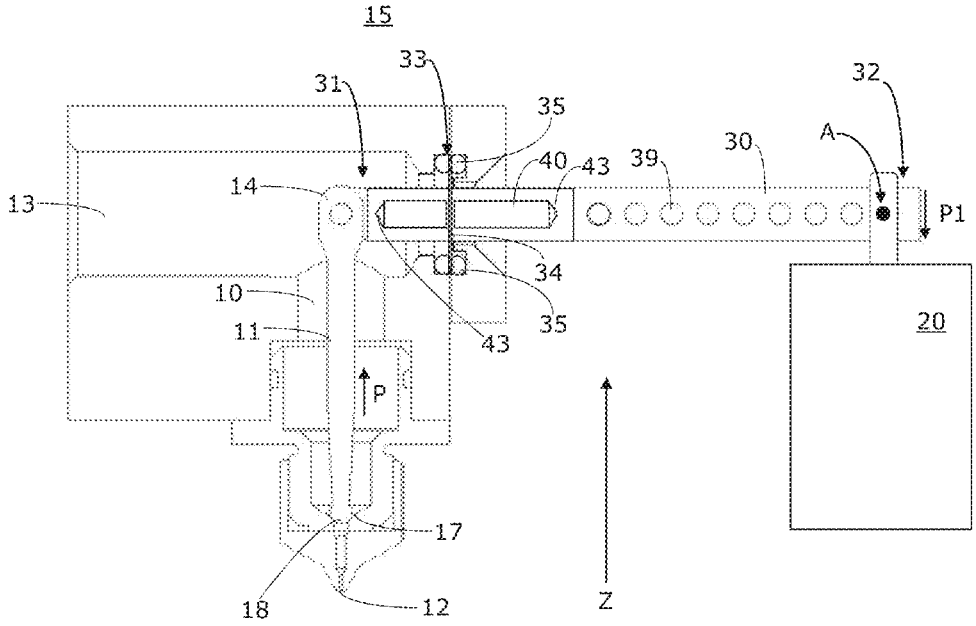
FIG. 2 shows a schematic sectional view of a further embodiment of the invention according to variant (A)

Each of the outlet openings 12 is implemented on or in a respective application head 15. Each application head 15 is especially designed for dispensing a flowable medium M, preferably adhesive, and comprises a (nozzle) chamber 10 in the interior of the application head 15. In the example shown, a nozzle needle 11 is mounted so that it is movable up and down in the interior of the (nozzle) chamber 10, the nozzle needle releasing the outlet opening 12 through an opening movement P of the nozzle needle 11. FIG. 2 shows an arrow P, which is directed upwards. An opening movement in arrow direction P raises the nozzle needle 11 and this releases the outlet opening 12 so that the medium M can escape from the nozzle chamber 10 through the outlet opening 12. In FIG. 1, four application heads 15 simultaneously permanently dispense a medium M in strip-shaped webs (beadings). The strip shape arises because of the passing movement, for example, of a paper web K or a workpiece or a substrate. The corresponding movement direction is identified by V.

FIG. 1 shows an optional (multichannel) control module 50, which is connected with respect to control via a control connection 52 (also called a control-technology operative connection) to the drive 20. Such a control module 50 can be used in all embodiments.

In the interior, a supply channel 13 is provided (see, e.g., FIG. 2), which is connected to the (nozzle) chamber 10. The supply channel 13 can be fluidically connected to a supply line 16 (see, e.g., FIG. 1), in order to be able to introduce the flowable medium M into the (nozzle) chamber 10. Four separate supply lines 16 are indicated in FIG. 1. However, a common supply line 16 can also be used for multiple application heads 15.

Furthermore, a drive 20 is provided for generating the opening movement P of the nozzle needle 11. In FIG. 1, the drive 20 is attached or flanged to the application heads 15. The drive 20 preferably comprises a separate drive 20 per application head 15, so that each outlet opening 12 can be opened and closed individually (i.e., independently of the others).

Embodiments in which the drive 20 is arranged spaced apart from the application head 15, as can be seen in FIG. 2, for example, are particularly preferred. However, it is important in the arrangement of the drive 20 in relation to the application head 15 (this statement applies for arrangements) that the mutual spacing is precisely defined and stable. This aspect is important since any spacing change can have an influence on the function or mode of operation of the lever arm 30. Details on the lever arm 30 are described hereinafter.

Further details will be explained by reference to another embodiment, which is shown in a section in FIG. 2. FIG. 2 shows a section through an individual application head 15, in which the drive 20 is arranged spaced apart (i.e., spatially separated). According to the invention, the application head 15 comprises one lever arm 30 per drive 20, whose first extremal end 31 is fastened movably on a rear end 14 of the nozzle needle 11 or another movable element and whose second extremal end 32 is connected to the drive 20. A membrane suspension 33 having a membrane 34 is used, the lever arm 30 extending through the membrane 34 of the membrane suspension 33. The membrane suspension 33 is used for the purpose of connecting the lever arm 30 movably to the application head 15. In addition, the membrane suspension 33 is used as a seal to prevent the flowable medium M from escaping from the (nozzle) chamber 10. That is, the membrane 34 or the membrane suspension 33, respectively, has a double function. In addition, depending on the design of the membrane 34, it has a protective function with respect to temperature, corrosion, abrasion, and chemical additives of the medium M.

The following further details distinguish this embodiment. However, these details are also applicable to all other embodiments. The (nozzle) chamber 10 is designed so that in its lower region, close to the outlet opening 12, a stop point 17 or a stop surface (also referred to as a needle seat), respectively, is provided for the tip 18 of the nozzle needle 11. In FIG. 2, the nozzle needle 11 is shown in the closed position, i.e., the tip 18 of the nozzle needle 11 is seated tightly at the stop point 17 and no medium M can escape through the outlet opening 12. As soon as the nozzle needle 11 is raised in the direction of the Z axis by the opening movement P, the outlet opening 12 is released and medium M can escape.

The nozzle needle 11 is connected movably (like a toggle joint) to the lever arm 30 in the region of the rear end 14. The nozzle needle 11 more or less "dangles" in the nozzle chamber 10. Since the nozzle chamber 10 and the nozzle needle 11 are designed to be conically rotationally-symmetric in the lower area (close to the stop point 17), the nozzle needle 11 is guided in a centred manner during a downwards movement in the −Z direction. In addition, the medium M, which flows from the supply channel 13 through the (nozzle) chamber 11 in the direction of outlet opening 12, contributes to stabilization or self-centring, respectively, of the nozzle needle 11. This type of "dangling" mounting or suspension can be applied in all embodiments.

The lever arm 30 is designed here so that it comprises a flat, rectangular, or strip-shaped rod, which is optionally provided with holes 39 here. These holes 39 are used to make the rod lighter in order to reduce the mass to be accelerated. In addition, the holes 39 allow a displacement of the attachment point A of the drive 20. Therefore, if the effective lever arm is to be lengthened, the drive 20 (or the attachment point A, respectively) can be shifted further in the direction of the second extremal end 32 and vice versa. In the example shown, the drive 20 is seated almost on the extremal end 32, i.e., the effective lever arm is relatively long. The closer the drive 20 (or the attachment point A, respectively) is displaced in the direction of the membrane suspension 33, the shorter the effective lever arm. A step-down transmission occurs in the case of a large lever arm, i.e., a large movement P1 causes a small movement P in the opposite direction. The step-down factor in FIG. 2 is approximately 5:1 (i.e., the absolute value of the movement P1 is approximately 5 times as large as the absolute value of the movement P). In the case of a small lever arm, a step-up transmission occurs, i.e., a small movement P1 causes a large movement P in the opposite direction.

A step-down transmission having a step-down factor between 2:1 and 10:1 is preferably used in all embodiments. A step-down transmission of 1:1 is quite particularly preferred.

Figure 7:
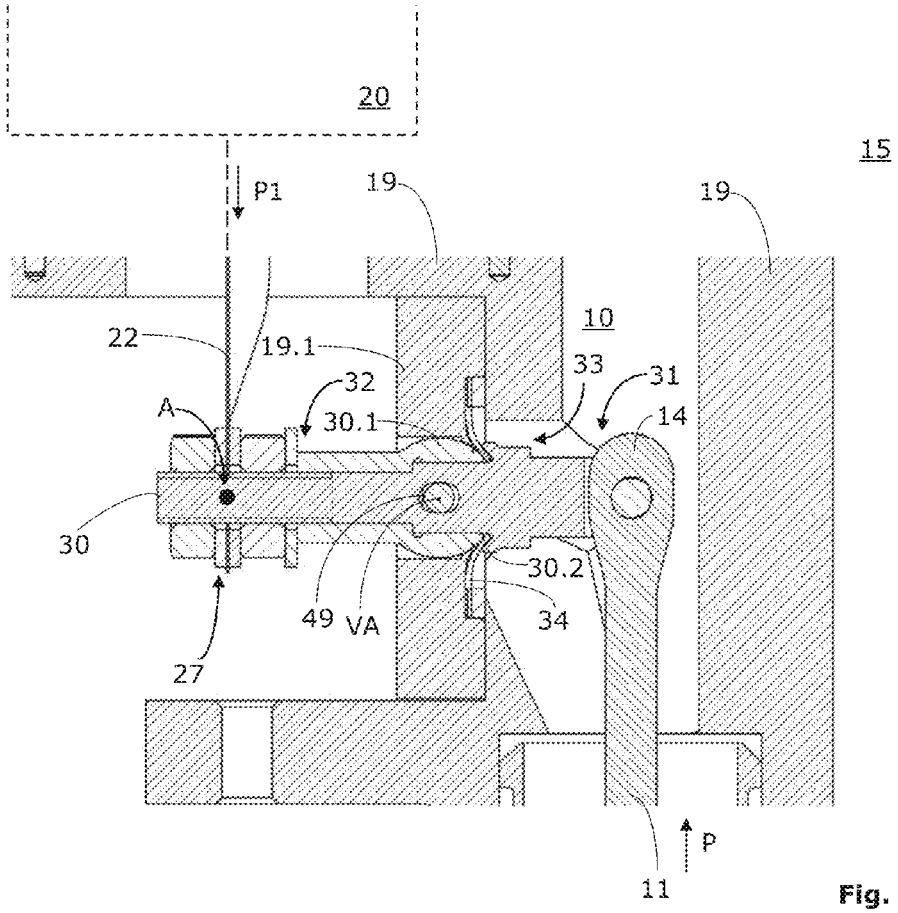
FIG. 7 shows a schematic sectional view of a further embodiment of the invention according to variant (A)

However, the lever arm 30 can also have any other rod or lever shape. The lever arm 30 is preferably manufactured from torsion-resistant material. In addition, the lever arm 30 should be as light as possible in order to have a small moved or accelerated mass. The membrane 34 is used in all embodiments as a kinematic support, which carries/mounts a part of the mass of the lever arm 30. In addition, the membrane 34 defines the precise pivot or tilting point (referred to as the virtual pivot axis) of the lever arm 30 in all embodiments. In most embodiments, the lever arm 30 can also be designated as a completely "free-floating" membrane-mounted lever because of the special membrane mounting 34. Only in the embodiment according to FIG. 7 is the lever arm 30 designed to be not completely free-floating but is additionally rotationally mounted.

In order to be able to mount or hold the lever arm 30 in the membrane suspension 33, a cylindrical rod 40 is provided on the lever arm 30 in the embodiment shown in FIG. 2. This cylindrical rod 40 pinches or clamps the membrane 34 and therefore provides a suspension of the lever arm 30 on the membrane 34. Details of an exemplary preferred arrangement can be inferred from FIG. 4. This type of suspension can be applied in all embodiments.

Figure 4:
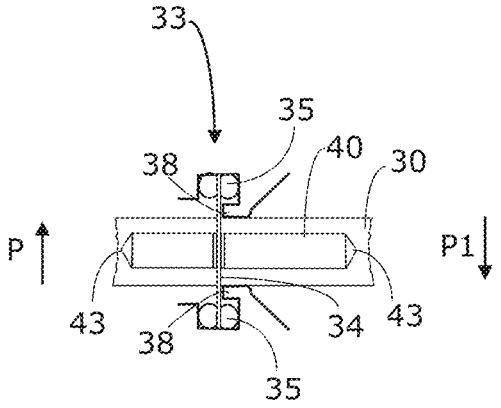
FIG. 4 shows an enlarged schematic sectional view of a further embodiment of the invention according to variant (A)

It can furthermore be identified in FIGS. 2 and 4 that the membrane 34 can comprise one or two sealing rings 35, which allow the membrane 34 to be elastically clamped in the application head 15. The sealing rings 35 are optional. For the purpose of clamping, the application head 15 can comprise a removable part or a lid (not shown in FIG. 2). In FIG. 7, this clamping is accomplished, for example, between a part or element 19.1 and the housing 19. If this part or this lid is removed, the membrane 34 including the optional sealing rings 35 can be inserted. The said part or the lid is then fastened again and the membrane 34 is clamped.

It can be seen in FIG. 4 that on the rear side of the membrane 34, i.e., on that side which faces away from the (nozzle) chamber 10, an optional pressure support 38 is provided, which is used as a mechanical stop for the membrane 34. Through this preferred embodiment, overstretching of the membrane 34 is prevented in the event of an overpressure in the nozzle chamber 10. The membrane 34 is preferably designed and arranged in all embodiments so that it is only strained by bending, which lengthens the service life. Instead of the pressure support 38, a support 23 according to the embodiments still to be described (see FIGS. 7-12) can also be used. The pressure support 38 and the support 23 can also be combined.

A metallic membrane 34 is preferably used in the various embodiments, which is particularly suitable for alternating load at high frequencies. A membrane 34 in which either the entire membrane surface consists of metal, or in which a planar membrane substrate (e.g., made of plastic) is provided with a metal layer/metal vapour deposit, is designated as a metallic membrane 34.

A metallic membrane preferably comprises an alloy of a transition metal in all embodiments.

Furthermore, it can be seen from FIGS. 2 and 4 that a counter movement P1, which is caused by the drive 20, causes an opposing opening movement P of the nozzle needle 11. The lever arm thus ensures a definition of the step-down or step-up transmission and a movement reversal.

Figure 3A:
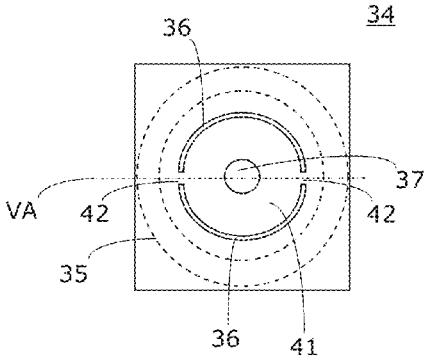
FIG. 3A shows a plan view of a membrane of a further embodiment of the invention according to variant (A)

FIG. 3A shows details of a preferred embodiment of a membrane 34. The membrane 34 comprises slots 36 to increase the elasticity. In addition, a central opening 37 is provided, through which the lever arm 30 runs in the installed state. The location of the sealing ring or rings 35 is indicated in FIG. 3A. This design of the membrane 34 is particularly suitable for metallic membranes 34 in order to provide the metallic membrane 34 with the required elasticity and in order to predefine a nonlinear movement function if required.

Through the special arrangement of the slots 36, which almost define a complete circle, two small webs 42 are obtained at the three o'clock and nine o'clock positions. These two small webs 42 allow bending of the inner part 41 (i.e., that circular region 41 of the membrane 34 which is delimited on the outside in the radial direction by the slots 36) of the membrane 34. The two small webs 42 with the inner part 41 of the membrane 34 as it were define a virtual pivot axis VA. This virtual pivot axis VA is shown in FIG. 3 by a dot-dash line.

Figure 3B:
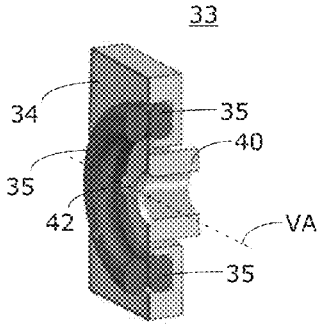
FIG. 3B shows a perspective sectional view of a membrane suspension of a further embodiment of the invention according to variant (A)

FIG. 3B shows details of a preferred embodiment of a membrane suspension 33. The fastening of the lever arm 30 on the membrane 34 can be seen here. This fastening is performed by the rod 40, as described. In the embodiment shown, the rod 40 is internally hollow to reduce the weight. In order that no medium M can escape through the interior of the rod 40, the rod 40 can be provided with caps 43 or sealing elements on both ends, for example. The location of the virtual pivot axis VA is also indicated in FIG. 3B. The details shown in FIG. 3B can be applied to all embodiments.

Figure 5:
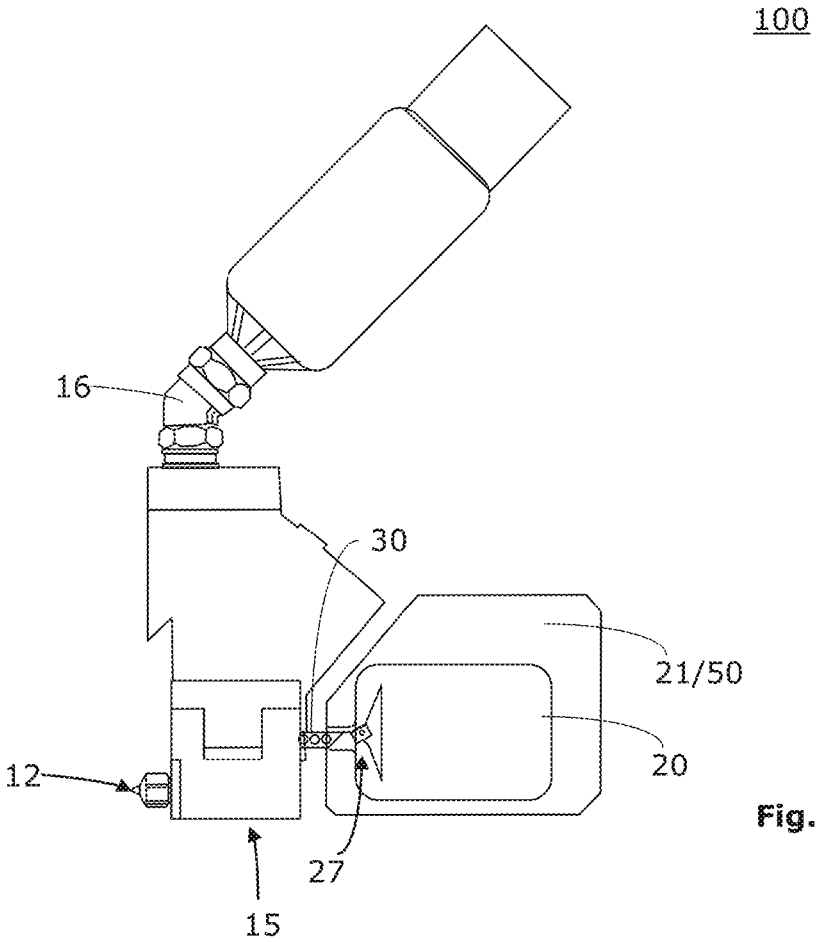
FIG. 5 shows a schematic sectional side view of a further embodiment of the invention according to variant (A)

FIG. 5 shows details of a further embodiment of the invention. The arrangement of the elements is selected differently here but the function is the same. A linear movement of the drive 20 is converted into an opening movement of the nozzle needle 11 in the interior of the application head 15. The drive 20 is also implemented separately (i.e., spaced apart) from the application head 15 here, as also in FIG. 2.

In the various described embodiments, an
electromagnetic or
pneumatic or
piezoelectric drive
is suitable as the drive 20, which generates a corresponding linear movement P1 (up and down movement) at the desired frequency, which is relayed by the effective active lever arm 30 through a step-down or step-up transmission to the nozzle needle 11 and induces the linear movement P therein. In the case of a piezoelectric drive 20, however, a step-up transmission is preferably used here in order to convert the very small movements of the piezoelectric drive 20 into sufficiently large opening and closing movements P.

An electromagnetic drive 20 which is constructed according to the principle of a voice coil motor or a Lorentz coil has particularly proven itself. In this case, a 1:1 lever transmission ratio or a step-down transmission is particularly suitable in this case as the effective transmission ratio. A voice coil motor or a Lorentz coil can be used in all embodiments.

A voice coil drive 20 has the advantage that it is de-energized in the idle state, i.e., the power consumption is less than in previous application heads.

The stroke in the region of the nozzle tip 18 or the outlet opening 12 in the direction of the Z axis is preferably between 0.1 mm and 1 mm. In the case of a 1:1 lever transmission ratio, the drive 20 must therefore make a corresponding movement P1 in the opposite direction having a stroke of 0.1 mm to 1 mm.

With a suitable control of the drive 20, e.g., via a driver module 21 and/or a control module 50, which can be disposed in the proximity of the drive 20, as indicated as an example in FIG. 5, the movement behaviour of the nozzle needle 11 or another movable element can be set or even regulated. If desired, a suitable movement profile can be stored so that the nozzle needle 11 is decelerated shortly before it impinges upon the stop point 17. This measure lengthens the service life of the nozzle needle 11 and the application head 15. A corresponding driver module 21 and/or control module 50 can be used in all embodiments.

The greater the lever step-down transmission ratio is selected to be, the more precisely can the nozzle needle 11 be moved because a large movement P1 of the drive 20 is stepped down into a small movement P of the nozzle needle 11. A disadvantage of such a large step-down transmission ratio, however, is the increased distance which must be covered on the drive side. The achievable frequency or the maximum cycle, respectively, of the opening and closing movement of the nozzle needle 11 is thereby possibly reduced.

In a preferred embodiment, on the drive side, an intelligent controller (e.g., in the form of the driver module 21 and/or control module 50) of the drive 20 is designed so that the current which is fed into the drive 20 is observed. When the current increases, this is an indication that the nozzle needle 11 or the movable element is at the stop point 17. Through an intelligent control module 50, a gradual adaptation of the movement profile stored in the driver module 21, which can be defined in all embodiments by the said parameterization, can be performed, which compensates for wear of the needle tip 18 whereby the movement P1 on the drive side is successively increased when the current signal indicates that the current increase only occurs later in relation to earlier. The later occurrence of a current increase specifically means that the needle tip 18 is at the stop point 17 later than heretofore. This is an indication of wear. The use of such an intelligent controller (e.g., in the form of the driver module 21 and/or control module 50) lengthens the service life of the application head 15 since the nozzle needle 11 or the movable element must only be replaced later.

In a preferred embodiment, on the drive side, an intelligent controller (e.g., in the form of the driver module 21 and/or control module 50) of the drive 20 is designed so that the movement of the nozzle needle 11 or the movable element is regulated according to a predefined movement profile (e.g., P1(t, −Z)). The switching times and the stroke of the nozzle needle 11 can be monitored and the application pattern of the application head 15 can be automatically corrected by the control module 50.

The driver module 21 and/or the control module 50 is preferably located directly on each drive 20 so that the drive 20 can be activated directly using a 24 VDC signal (also directly by a PLC) (PLC stands for programmable logic controller). This has the advantage that each application head 15 can be activated individually. A corresponding driver module 21 and/or control module 50 can be used in all embodiments.

In a preferred embodiment, on the drive side, an intelligent controller of the drive 20 is designed so that error, warning, service, or maintenance indicators are output. The control module 50 is appropriately equipped and/or programmed for this purpose. This approach can be used in all embodiments.

It is an advantage of the invention that a spatial thermal separation (see, e.g., FIG. 5) is possible between drive 20 and the part of the application head 15 around which the medium M flows. Particularly in the case of warm or hot medium M, the problems which can otherwise be caused on the drive side due to the high temperature are thus reduced.

In all preferred embodiments, the lever arm 30 causes a reversal of the movement direction (P1 points in the opposite direction as P; see, for example, FIG. 2) and, depending on the setting of the lever arm lengths, a movement amplification (P>P1; referred to as step-up transmission) or a movement reduction (P1>P; referred to as step-down transmission). In addition, the angled arrangement of the lever arm 30 in relation to the movable element 11 allows an arrangement of the membrane 34 in a region which is not directly subjected to the flowing medium M.

The invention allows a precise custom adhesive application. It can be used in electromagnetic, electro-pneumatic, piezoelectric or electromechanical application heads 15, whether hot or cold glue processes, whether based on distance or time and whether constant or variable substrate speed.

The control module 50 (also referred to as the application controller) can be integrated directly in the device (e.g., in a melting device) or it can be provided as an independent unit. It is also possible according to the invention to control and monitor multiple application heads 15 from a common (multichannel) control module 50, as indicated in FIG. 1.

Figure 6:
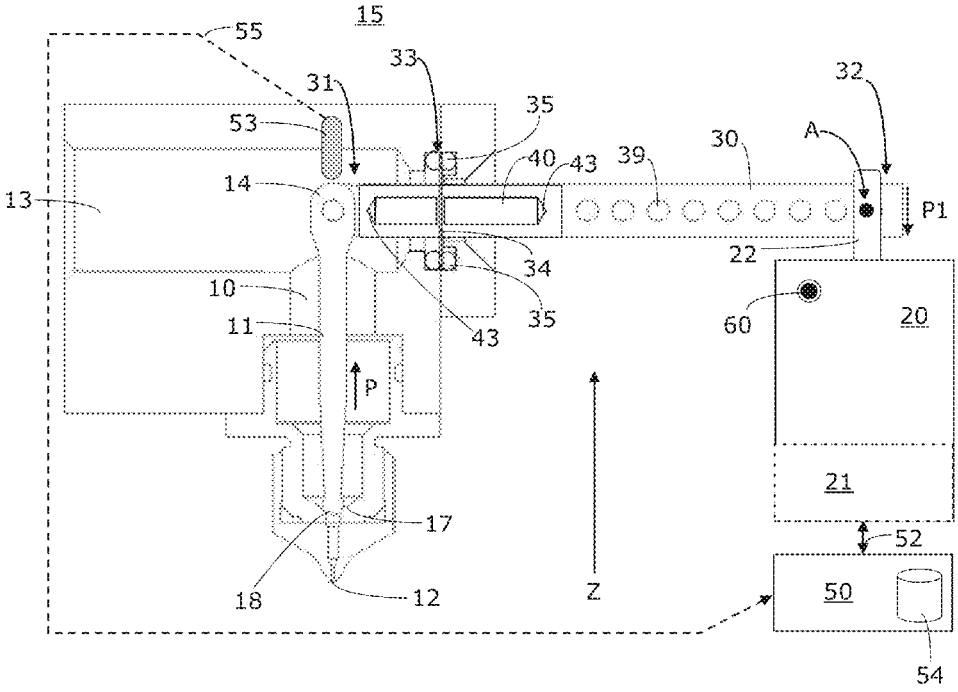
FIG. 6 shows a schematic sectional view of a further embodiment of the invention according to variant (A) based on the embodiment shown in FIG. 2, where details of a control module and a control circuit are indicated schematically.

FIG. 6 shows a schematic sectional view of a further embodiment of the invention based on the embodiment shown in FIG. 2, details of the control module 50 and a control loop being schematically indicated. Reference is made to the description of FIG. 2. Only the essential aspects of the activation and the control loop are described hereafter. All embodiments of the invention preferably have a control loop having a (distance or position) sensor 53 (an inductive sensor here, for example) and a control module 50. The sensor 53 is designed for the purpose of detecting the instantaneous position (actual position) of the movable element 11. The (distance or position) sensor 53 is schematically shown in FIG. 6. It can also be arranged at another location. The (distance or position) sensor 53 is connected via a connection 55 to an input of the control module 50, to transfer the actual position to the control module 50. The control module 50 ascertains on the basis of control data, through the comparison with the actual position, whether there is a need for readjustment or correction.

It is further indicated in FIG. 6 that an optional driver module 21 can be provided between the control module 50 and the drive 20 in order to produce the control connection between control module 50 and drive 20. The driver module 21 can receive parameters from the control module 50 and convert them into current or voltage variables (as control variables), which are applied to the drive 20. The control module 50 can also be directly connected with respect to control to the drive 20 (e.g., by a control connection 52, as shown in FIG. 1).

In all embodiments, the parameters are preferably taken from a parameter memory 54 and transferred by the control module 50 to an optional driver module 21. The driver module 21 then converts these parameters into control variables. However, it is also possible that the control module 50 further processes parameters in order to then transfer further-processed parameters to the driver module 21. The further processing of the parameters is dependent on the specific configuration and can take into consideration the step-up or step-down transmission factor, for example.

Details of a further embodiment which is shown in a section in FIG. 7 are explained hereinafter. The embodiment shown in FIG. 7 is based in principle on the embodiment shown in FIG. 2. Reference is therefore made to the description of FIG. 2.

FIG. 7 shows a section through a part of a single application head 15 in which the drive 20 is disposed spaced apart (i.e. spatially separated). The drive 20 is only indicated highly schematically in FIG. 7. The movement technology coupling between the drive 20 and the lever arm 30 is accomplished by means of a so-called drive coupling 22. Preferably in all embodiments a connecting rod serves as drive coupling 22. Particularly preferably this connecting rod is made of a thin material which in itself allows a slight bending which is important since the movement transmission of the drive-side movement P1 to the lever arm 30 does not proceed absolutely linearly but follows a slightly curved movement path.

The application head 15 here comprises a lever arm 30, whose first extremal end 31 is movably fastened to a rear end 14 of the nozzle needle 11 or another movable element and whose second extremal end 32 is connected in terms of movement technology via the drive coupling 22 to the drive 20. A membrane suspension 33 comprising a membrane 34 is used, where the lever arm 30 extends through the membrane 34 of the membrane suspension 33. The membrane suspension 33 is used inter alia to connect the lever arm 30 movably to the application head 15. In particular in the embodiment shown here the membrane suspension 33 serves as a seal in order to prevent any escape of flowable medium M from the (nozzle) chamber 10. That is, the membrane 34 or the membrane suspension 33 has a double function. In addition, depending on the configuration of the membrane 34, it has a protective function with respect to temperature, corrosion, abrasion and chemical additives of the medium M. The embodiment shown is further characterized in that the lever arm 30, in addition to the mounting in the membrane 34, is also mounted about a pivot or tilting point 49. The pivot or tilting point 49 defines the virtual axis VA. The lever arm 30 has a corresponding recess so that the lever arm 30 can be placed or plugged onto the pivot or tilting point 49, as shown in FIG. 7.

Preferably in the embodiment shown in FIG. 7 the lever arm 30 has a spherical region 30.1 and a circumferential collar 30.2. The membrane 34 is clamped between the circumferential collar 30.2 and the spherical region 30,1. The membrane 34 is preferably clamped or braced in the region of the outer membrane circumference between a section of the housing 19 and a plate, a cover or a counterpiece 19,1. The membrane 34 is elastically deformable between this "outer clamping" and the "inner clamping" which is preferably accomplished between the circumferential collar 30.2 and the spherical region 30.1. It is an advantage of the "outer clamping" and the "inner clamping" that a good seal is ensured against the escape of the medium M from the chamber 10. The spherical region 30.1 of the lever arm 30 additionally serves as a pressure support in order to prevent the high pressure of the medium M in the chamber 10 pressing the membrane 34 too far to the left or even tearing the membrane 34.

Figure 8:
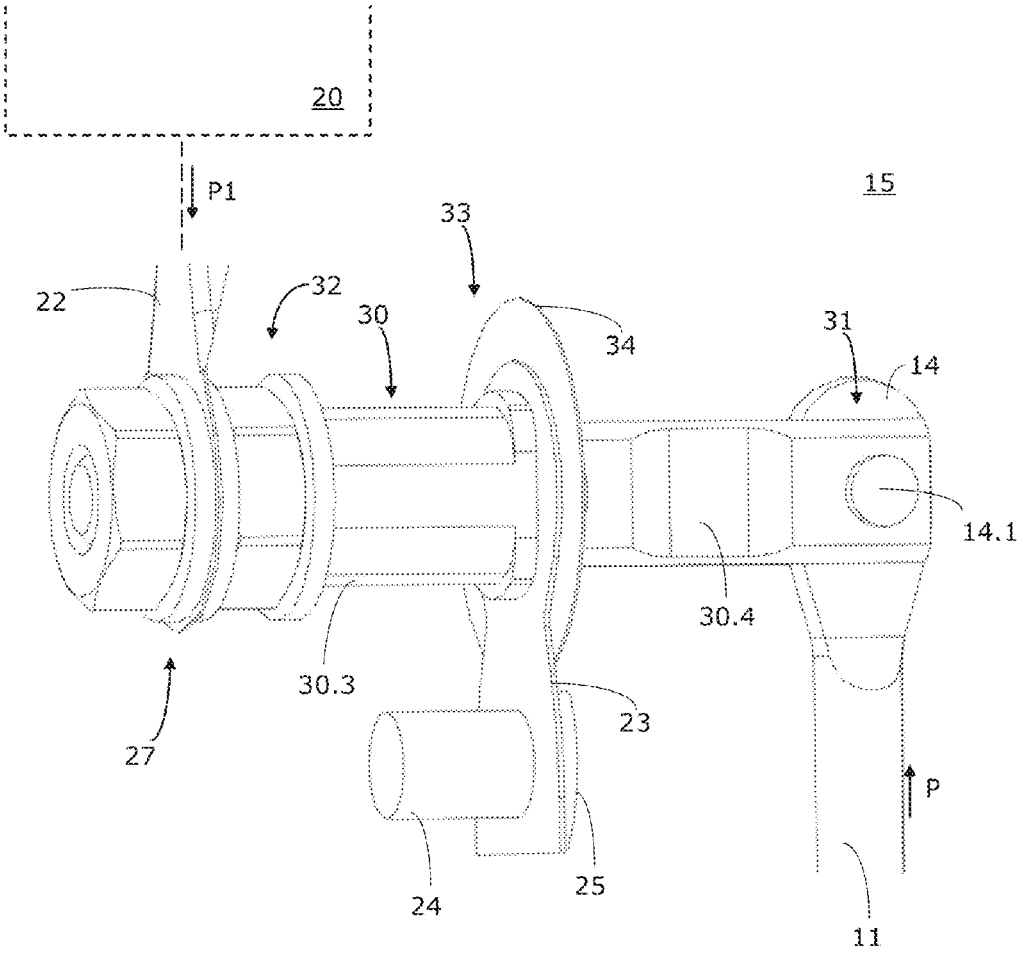
FIG. 8 shows a schematic sectional view of a further embodiment of the invention according to variant (A)

Details of a further embodiment which is shown in a perspective view in FIG. 8 are explained hereinafter. The embodiment shown in FIG. 8 is based in principle on the embodiments shown and described so far. Reference is therefore made to the preceding description.

FIG. 8 shows a part of a single application head 15 in which the drive 20 is disposed spaced apart (i.e. spatially separated). The drive 20 is only indicated highly schematically in FIG. 8. The movement technology coupling between the drive 20 and the lever arm 30 is accomplished by means of a so-called drive coupling 22. Preferably in these embodiments also a connecting rod serves as drive coupling 22. Particularly preferably this connecting rod is made of a thin material which in itself allows a slight bending.

The application head 15 comprises according to FIG. 8 a lever arm 30, whose first extremal end 31 is movably fastened to a rear end 14 of the nozzle needle 11 or another movable element and whose second extremal end 32 is connected in terms of movement technology via the drive coupling 22 to the drive 20. A membrane suspension 33 comprising a membrane 34 is used, where the lever arm 30 extends through the membrane 34 of the membrane suspension 33. The membrane suspension 33 is used inter alia to connect the lever arm 30 movably to the application head 15. In addition, the membrane suspension 33 also serves as a seal in order to prevent any escape of flowable medium M from the (nozzle) chamber 10 (the chamber 10 is not shown here Furthermore, the membrane 34 is provided or fitted with a so-called support 34. This support 23 is preferably designed and connected or in contact with the membrane 34 so that on the one hand it reinforces or stabilizes the membrane. On the other hand, the support 23 is intended to define the mobility of the membrane 34 or the entire membrane suspension 33.

In a preferred embodiment a nonlinear movement is predefined by the membrane 34 in cooperation with the support 23, which accelerates/reinforces the closing movement (downward movement of the needle 11 or the movable element). By this means, a firm and defined impact of the needle tip 11 on the stop point 17 (cannot be identified in FIG. 8) can be ensured, which is important for an optimal tearing of the medium M. In addition, a sufficient pressing force of the needle tip 18 against the stop point 17 can thus be predefined. When opening the outlet opening 12 (cannot be identified in FIG. 8), i,e. during the upward movement of the needle 11, a more gentle movement profile can be used.

The support 23 can define the mobility of the membrane 34 or of the entire membrane suspension whereby this is provided with a pin 24 in a lower region which can be fastened to the support 23 by means of a clamp 25. The pin 24 can optionally be guided in a guide of the housing 19 (not shown).

Figure 9:
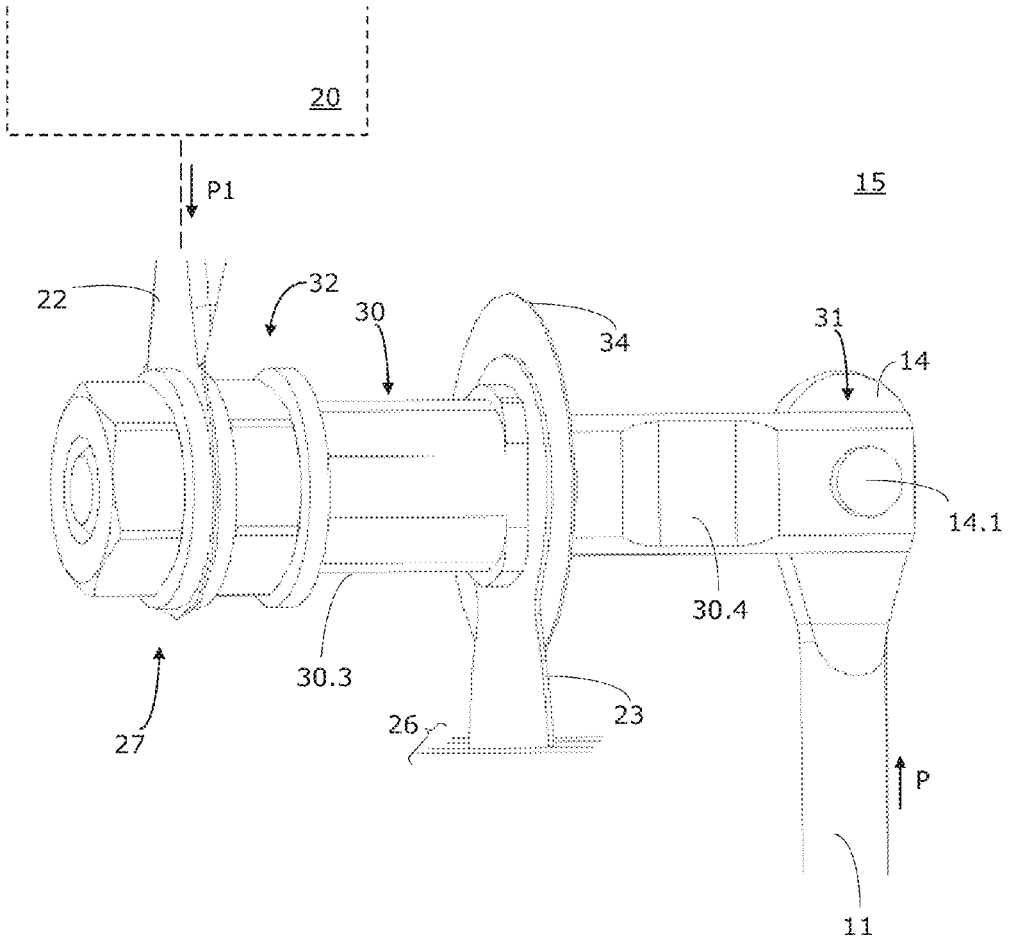
FIG. 9 shows a schematic sectional view of a further embodiment of the invention according to variant (A)

Alternatively the support can also be fixed by a housing clamp 26 in the lower region, as indicated in FIG. 9. Otherwise, all the elements of the embodiment shown in FIG. 9 are identical to the elements of FIG. 8. Thus, reference is made to the description of FIG. 8.

Preferably in all the embodiments the support 23 is made of a thin, inherently flexible but stable material. It can comprise a metal or plastic support 23. In all the embodiments, the thickness of the support 23 is preferably between 0.1 mm and 0.15 mm.

In all the embodiments the membrane 34 preferably has a thickness which is 0.08 to 0.15 mm.

Preferably in all the embodiments the lever arm 30 has a two-part or multipart structure. It can, for example, comprise a rocker 30.4 and a sleeve 30.3 (see FIG. 8 or 9). The membrane 34 can then be clamped or braced between the rocker 30.4 and the sleeve 30.3 (see FIG. 2, 4, 6A, 7, 8, 9 or 10).

Preferably in all embodiments the lever arm 30 is provided at the drive-side end 32 with means which enable a movement-technology connection to the drive 20, preferably via a drive coupling 22. Particularly preferred are clamping means or screw means 27 as shown in FIGS. 5, 7, 8 and 9.

The problem can be solved particularly advantageously with the solutions according to FIGS. 8 and 9, which results from the fact that a membrane 34 can typically only absorb small closing forces. In order to achieve a cleaner tearing of adhesive (tearing of medium), an "impact" of the needle tip 18 on the valve seat 17 is advantageous. In order to prevent the rebound of the movable element or the needle, a relatively large force must be applied for dosing. This force can be absorbed particularly well by the membrane suspension described in connection with FIGS. 8 and 9.

In all the embodiments the support 23 can be designed separately or integrated in the membrane.

The membrane 34 is shown in round or oval basic shape in the figures but can also have a different basic shape.

Figure 10:
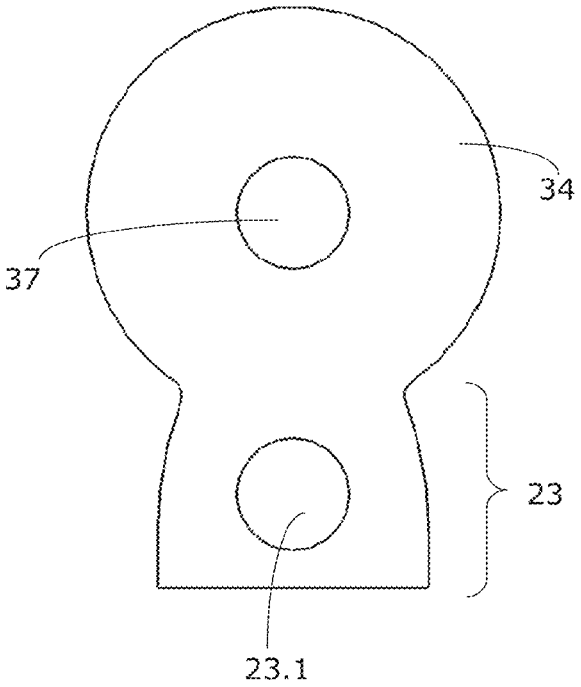
FIG. 10 shows a schematic view of a further embodiment according to variant (A) with a membrane according to variant (A)

The membrane 34 can, for example, have a shape as in FIG. 10. The membrane according to FIG. 10 has an integrated support 23, i.e. it is manufactured in one piece. In the region of the support 23 a hole 23.1 can optionally be provided to attach/firmly clamp a pin 24. The region of the support 23 can also be designed without hole 23.1. In this case, for example, the lower region of the support 23 can be clamped in or on the housing 19 in a housing damp 26 as indicated, for example, in FIG. 9.

In all the embodiments the membrane 34 can comprise a sealing ring 35 which is designed as a seal and for elastic clamping of the membrane 34 in the application head 15 (e.g. between the elements 19 and 19.1).

In the embodiments of FIGS. 8 and 9, the membrane 34 or the membrane suspension 33 has a multiple function. It is used as a seal, it defines the virtual tilt or pivot axis VA and it predefines a movement function (preferably a nonlinear function).

Figure 11:
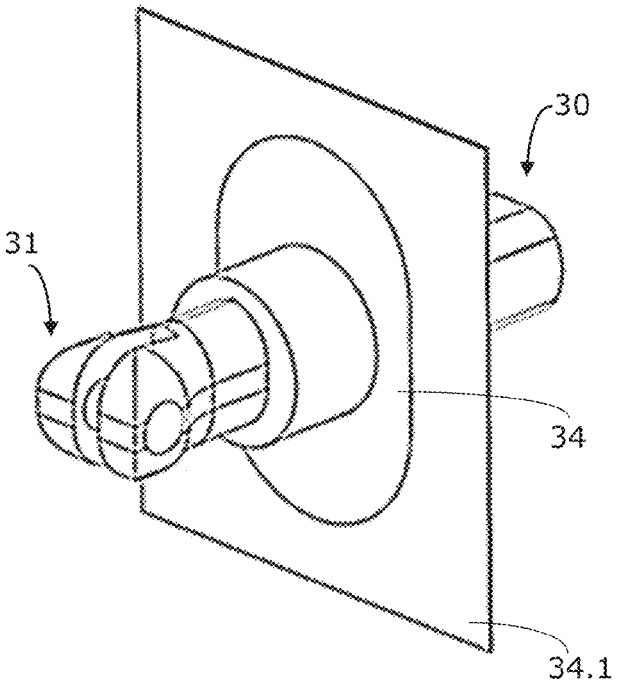
FIG. 11 shows a perspective view of a further embodiment according to variant (A) with a membrane according to variant (A)

FIG. 11 shows a perspective view of a further embodiment of a membrane 34. The membrane 34 here has an oval shape which is particularly preferred. The oval membrane 34 but also any other of the membranes 34 mentioned herein can be clamped or positioned in a flat holder or clamping setup. The membrane 34 of the various embodiments can however also be reinforced in the edge region 34.1, as indicated, for example, in FIG. 11.

FIG. 11 shows details of a possible embodiment of the lever arm 30. The first extremal end 31 of the lever arm 30 can be equipped with means for movable fastening to the movable element 11. These means can, as shown in FIG. 11, comprise a slot 31.1 and a hole 31.2 for passing through a pin 14.1 (as shown, for example, in FIGS. 8 and 9). The upper end 14 of the movable element 11 can be inserted into the slot 31.1 and fixed by the mentioned pin 14.1. Preferably the first extremal end 31 of the lever arm 30 is designed to be fork-shaped in all embodiments as shown in FIG. 11.

Figure 12:
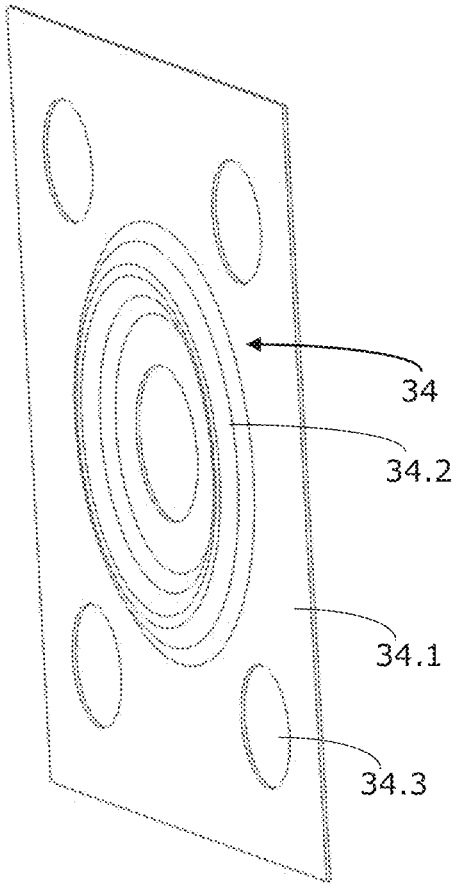
FIG. 12 shows a perspective view of a further embodiment of a membrane according to variant (A)

FIG. 12 shows a perspective view of a further embodiment of a membrane 34. The membrane 34 here comprises so-called beadings 34.2 which is particularly preferred. The membrane 34 with beadings 34.2 can be clamped or positioned in a flat holder or damping setup. The membrane 34 of FIG. 12 can however also be reinforced in the edge region 34.1 as indicated, for example, in FIG. 12. In the edge region 34.1 holes 34.3 or other fastening means can also be provided in order to be able to fix or clamp the membrane 34 better in an application head 15.

The beadings 34.2 preferably run concentrically to the central opening through which the lever arm 30 runs in the mounted state.

Preferably the beadings 34.2 are designed to be dome-shaped.

In addition, depending on the configuration of the membrane 34, this can also have a protective function against temperature, corrosion, abrasion and chemical additives of the medium M.

FIGS. 13, 14, 16A, 16B and 17 show a first embodiment of the invention according to variant (B), i.e. a lever arm suspension configured as a rocker mounting 133. FIG. 15 shows a schematic cross-sectional view of a schematic second embodiment of a rocker mounting 133 according to variant (B).

As shown in FIGS. 13, 14, 16A, 16B and 17 for the first embodiment and in FIG. 15 for the second embodiment, the lever arm suspension configured as rocker mounting 133 comprises a lever arm 130 which is connected to the movable element 111 and the drive 20, a plate element 160 with an opening 162 through which the lever arm 130 extends, a rocker mounting device 140 which is designed to connect the lever arm 130 movably to the plate element 160, and a sealing device 180 which is configured to prevent any escape of adhesive from the chamber through the opening 162 in the plate element 160. The lever arm 130 is movably mounted by means of the rocker mounting device 140 so that a drive-side movement P1 (see FIG. 16A) is converted into the opening movement P (see FIG. 16A) of the movable element 111.

As shown in FIGS. 15 to 17 for the first and second embodiment, the rocker mounting device 140 comprises a rocker element 142, which is connected rigidly to the lever arm 130 and comprises a longitudinal direction 144 and a first and a second mounting point 146, 148 as well as a correspondingly associated first and second support device 152, 154 which are disposed on a rocker bearing side of the plate element 160 and which are configured to support the associated first and second mounting point 146, 148. The longitudinal direction 144 of the rocker element 142 extends substantially perpendicularly to the lever arm 130 and in a plane parallel to the plate element 160 (in the drawing plane of FIGS. 15 and 17). The first and second bearing point 146, 148 are disposed spaced apart along the longitudinal direction 144. The first and the second support device 152, 154 are configured as a first and second ball 153, 155. The plate element 160 has on its rocker bearing side a first and a second recess 164, 166 which are each configured as a plate-element-side ball seat 165, 167. On its side facing the plate element 160 the rocker element 142 has a first and a second recess 156, 158 which are each configured as a rocker-element-side ball seat 157, 159.

The diameter of each plate-side recess 156, 158 is greater, preferably about 0.1 mm greater than the diameter of the ball 153, 155.

Consequently, during operation of the adhesive application head 115 with the rocker mounting 133, the balls 153, 155 in the plate-element-side recess 156, 158 rest on an adhesive film. Furthermore, the first and the second balls 153, 155 are pressed in the respective rocker-element-side ball seat 157, 159 (as can be seen in FIGS. 15 and 17).

In an alternative configuration of the first and second embodiment (not shown), the first and second balls 153, 155 are pressed in the first and second plate-element-side ball seat 165, 167 and the diameter of each rocker-element side recess 156, 158 is greater, preferably 0.1 mm greater, than the diameter of the balls 153, 155 so that during operation the balls 153, 155 in the rocker-element-side recess 156, 158 rest on an adhesive film.

As shown in FIGS. 15 to 17, the sealing device 180 comprises an O ring 172 which is disposed on the side of the rocker element 142 around the opening 162. Accordingly, on the side of the rocker element 142 the plate element 160 has a plate-element-side O ring seat 173 surrounding the opening 162 and on its side facing the plate element 160 the rocker element 142 has a corresponding plate-element-side O ring seat 143.

In the first embodiment shown in FIGS. 16 and 17 the plate-element-side O ring seat 173 is a flange 173.1, formed at the rocker-element-side outlet of the opening 162, formed around the opening 162 having a first contact surface 173.2 parallel to the plate-element plane and a cylindrical inner-wall shaped second contact surface 173.3 which is configured to support an outer circumference of the O ring 172. Furthermore, the plate-element-side O ring seat 143 is configured as a flange 143.1 formed on the side of the rocker element 142 facing the plate element 160 having a first contact surface 143.2 parallel to the plate element plane and a cylindrical outer-wall-shaped second contact surface 143.3 which is configured to support an inner circumference of the O ring 172.

As shown in FIGS. 15 to 17 with reference to the first and second embodiment, the rocker mounting further comprises a spring element 180 which serves to pre-tension the rocker element 142 in the direction of the plate element 160 and the mounting points 146, 148. The spring element 180 is configured as a spiral spring 182 and is disposed on the side of the plate element 160 opposite the rocker bearing side around the lever arm 130. As shown in FIGS. 16 and 17, on its side opposite the rocker bearing side the plate element 160 has a plate-side seat 184 disposed around the opening 162 for the spring element 180 and on its outer drive-side end the lever arm 130 has a lever-arm-side seat 186.2 for the spring element 180, which is configured as flange 186,1.

As also shown in FIGS. 15 to 17 with respect to the first and second embodiment, the lever arm 130 is formed in two parts and on the rocker bearing side comprises a first sub-arm 136 which can be connected to the movable element 111 and on the side opposite the rocker bearing side a second sub-arm 138 which can be connected to the drive 22 via a connecting rod 122.

The second sub-arm 138 is formed in four parts and comprises a screw nut 138.1, lock nut 138.7, a screw rod 138.2 and a sleeve 186. The screw rod 138.2 has a screw nut thread 138.3, a lock nut thread 138,5 and a screw thread 138.4. The lock nut 138.7 is screwed onto the lock nut thread 138.5. The screw nut 138.1 is screwed onto the screw nut thread 138.5. Between the lock nut 138.7 and the screw nut 138.1, an end of the connecting rod 122 provided with a through-hole is plugged onto the screw rod 138.2 and fixed there by tightening the screw nut 138.1 against the lock nut 138.7.

The first sub-arm 136 has an inner thread 136.1 which is complementary to the screw thread 138.4 of the screw rod 138.2 and which receives the screw thread 138.4, the screw thread 138.4 engages with its outer end in the complementary internal thread 136.1 of the first sub-arm 136.

The sleeve 186 is disposed on the side (drive side) of the plate element 160 opposite the rocker element side and plugged onto the screw rod 138.2 so that it impacts against the lock nut 138.7. On its stop side the sleeve 186 has a flange 186.1 which serves as a lever-arm-side seat 186.2 for the spring element 180. The screw rod 138.2 extends through the sleeve 186. On the drive side an annular stop 184 is formed in the opening 162 of the plate element 160, which serves as a plate-side seat 184 for the spiral spring 182.

On the drive side of the plate element 160 the opening 162 is configured to be substantially funnel-shaped.

As from the preceding description of the first and second embodiment of variant (B) shown in FIGS. 13 to 17, the rocker mounting device 140 for the movable connection of the lever arm 130 to the plate element 130 functions substantially by means of the "ball mountings" achieved by means of the first and second balls 153, 155. Here the pivot axis for the lever arm runs along the direction from the first to the second ball. The balls 153, 155 absorb the compressive force of the adhesive. The plate element 160 is fixedly mounted in the adhesive application head 115 and the lever arm 130 executes as a "rocker" the opening movement P for the stroke of the movable element (piston rod) 111 in the order of magnitude of about +/−0.2 mm.

The sealing device 170 formed on the side of the ball mounting as O ring 172 dynamically seals the chamber 10, which in operation of the adhesive application head 115 is a pressure chamber filled with adhesive, against the external space which is at atmospheric pressure. In this case, the O ring 172 is not loaded uniformly along its circumference as is usual but during each stroke movement of the movable element 111 or during each rocker movement of the lever arm 130 is gently squeezed in sections. As can be seen from FIG. 16A, during a stroke of the movable element 111 in the direction P of the opening movement of the movable element 111, the O ring 172 is squeezed in sections on its upper side in FIG. 16A (i.e, on the side shown in the detailed view of FIG. 16B) and is unloaded on the opposite lower side. During a stroke of the movable element 111 in the direction opposite to the direction of the arrow P in FIG. 16A (i.e. downwards in FIG. 16A), the O ring 172 in FIG. 16A is accordingly squeezed on its lower side in FIG. 16A and unloaded on its upper side.

The spiral spring 182 pulls the balls 153, 155 into their seat or into the first and second support device 152, 154 in the plate element 160. This is particularly necessary at a low pressure (adhesive pressure) in the chamber 10. The diameter of the first and second support device 152, 154 (the ball seat) in the plate element 160 is greater, preferably about 0.1 mm greater, than the diameter of the corresponding balls 153, 155 so that during operation of the adhesive application head 115 the balls 153, 155 are mounted on an adhesive film and can move. The balls 153, 155 are pressed in the rocker element 142. However, the mounting can also be configured differently (not shown) whereby a respective ball seat having a diameter greater than that of a ball is provided in the rocker element and the balls are pressed in the plate element.

In the plate element 160 a uniformly or statically loaded second O ring 168 is inserted on the rocker element side. The second O ring 168 is used to seal the plate element 160 against the chamber housing 19, compare the rocker mounting 133 with the plate element 160 in FIG. 18A which is mounted on the housing 19.

The advantages of the configuration of the lever arm suspension as rocker mounting 133 according to variant (B) compared with the configuration as membrane suspension 33 according to variant (A) (see FIGS. 2 to 4 and 6 to 12) are as follows: the adhesive pressure is absorbed via the balls 153, 155. The pivot axis of the lever arm 160 is well-defined by the ball mounting. The force during the deflection of the lever arm 130 (the "rocker") always remains the same in contrast to the situation with the membrane 34 which has no linear or constant spring constant. The sealing of the pressure chamber or the chamber 10 against the external space can be formed by a standard element, i.e. the O ring 172. Should this be necessary in cases of larger stroke movements and correspondingly larger deflections of the lever arm 130, the sealing device 170 configured as O ring 172 can be replaced by a special seal, possibly in the manner of a sleeve (not shown).

In a lever arm suspension configured as membrane suspension 33 in which the sealing of the pressure chamber with respect to the external space is formed merely by the membrane 34 itself, in the event of a rupture of the membrane 34 an abrupt massive leakage or escape of adhesive from the chamber 10 into the external space can occur. In contrast to this, in a configuration of the lever arm suspension as a rocker mounting as shown in FIGS. 13 to 18, no such an abrupt leakage is possible.

The mounting of a lever arm suspension configured as a rocker mounting 133 in the adhesive film application head is simpler because the position of the lever arm 130 (of the "rocker") is uniquely defined. Finally the rocker mounting can overall be achieved less expensively because substantially standard elements (and nota special membrane 34) are built therein.

FIGS. 18A and 18B show a further embodiment of the invention according to variant (B) with a lever arm suspension configured as rocker mounting 133. The particular feature with this embodiment is the thermal separation between the drive 20 and the application head 115. The principle of the thermal separation between drive 20 and application head 15 shown in FIGS. 18A and 18B is also suitable for a configuration of the lever arm suspension as membrane suspension 33 according to variant (A).

The thermal separation between drive 20 and application head 15 is achieved not by a larger exterior surface of a housing of the drive 20 abutting flat against an exterior surface of the housing 19 around the chamber 10 and the exterior surfaces being connected to one another possibly by means of a screw connection but by the contact surfaces or possible heat conduction cross-sections between the drive 20 and the application head 15, 115 being as small as possible and formed without a screw connection according to the thermal decoupling device 190, shown in FIG. 18A and the sectional enlargement of FIG. 18B.

The thermal decoupling device 190 comprises an insulation plate 192 which is disposed between the drive 20 and the lever arm suspension 30, 133 and at least two cable tensioning devices 194 which each connect the drive 20 and the lever arm suspension 30, 133 to one another. A respective cable tensioning device 194 comprises a spacer/positioning bolt 196 disposed between the drive 20 and the lever arm suspension 33, 133 and a tensioning cable 198 which extends through the spacer/positioning bolt 196 and is anchored at one end thereof by means of a drive-side anchoring 199.1 in the drive 20 and at the other end thereof in a lever-arm side anchoring 199.2 in the lever arm suspension 33, 133.

In the embodiment with the thermal decoupling device 190 shown in FIG. 18 the insulation plate 192 is placed on the application head 15, 115, two positioning bolts 197 are formed on the application head side and four spacer/positioning bolts 196 are formed on the drive side. The fixing of the drive 20 on the application head 15, 115 is accomplished by means of the tensioning cables 198 which are preferably formed as non-heating-conducting or poorly heat-conducting cables, e.g. as steel cables. The steel cables 198 are each fixed in the application head 15, 115 by means of a lever-arm-side anchoring 199.2 and in the drive 20 by means of a drive-side anchoring 199.1. The drive-side anchoring 199,1 is configured as a tensioning device for the tensioning cable 198.

As a result of the configuration of the thermal decoupling device 190 between the drive 20 and the application head 15, 115 according to FIG. 18A and 18B, the drive 20 is only fastened to the application head 15, 115 over a relatively small cross-sectional area and, if no metallic tensioning cables 198 are used, not by means of a metallic, poorly to non-heat-conducting connection.

All the considerations or embodiments of the coupling of the drive 20 to the lever arm, the coupling of the movable element 111 to the lever arm and the control of the drive 20 which are mentioned with respect to FIGS. 2 to 12 with regard to the configuration of the lever arm suspension as membrane mounting 33 according to variant (A) can &so be applied to the configuration of the lever arm suspension as rocker mounting 133 according to variant (B) shown in FIGS. 13 to 18. Conversely all the relevant considerations or embodiments which are mentioned with respect to FIGS. 13 to 18 with regard to the configuration of the lever arm suspension as rocker mounting 133 according to variant (B) can also be applied to the embodiment of the lever arm suspension as membrane suspension 33 according to variant (A) shown in FIGS. 2 to 12.

| Reference list | |
|---|---|
| (Nozzle) chamber | 10 |
| Movable element (e.g. nozzle needle) | 11 |
| Outlet opening | 12 |
| Feed channel | 13 |
| Rear end of nozzle needle 11 or of the movable element | 14 |
| Pin | 14.1 |
| Application head | 15 |
| Supply line | 16 |
| Stop point | 17 |
| Tip | 18 |
| Housing | 19 |
| Plate, counterpiece | 19.1 |
| Drive | 20 |
| Driver module | 21 |
| Drive coupling | 22 |
| Support | 23 |
| Hole | 23.1 |
| Pin | 24 |
| Clamping | 25 |
| Housing clamping | 26 |
| Clamping means or screw means | 27 |
| Lever arm | 30 |
| Spherical region | 30.1 |
| Circumferential collar | 30.2 |
| Sleeve | 30.3 |
| Rocker | 30.4 |
| First extremal end | 31 |
| Slot | 31.1 |
| Hole | 31.2 |

-continued

| Reference list | |
|---|---|
| Second extremal end | 32 |
| Membrane suspension | 33 |
| Membrane | 34 |
| Edge region | 34.1 |
| Beadings | 34.2 |
| Holes | 34.3 |
| Sealing ring | 35 |
| Slots | 36 |
| Central opening | 37 |
| Pressure support | 38 |
| Holes | 39 |
| Cylindrical rod | 40 |
| Inner part of membrane 34 | 41 |
| Webs | 42 |
| Caps | 43 |
| Pivot or tilting point | 49 |
| Control module (application control) | 50 |
| Control connection | 52 |
| Sensor (e.g. inductive sensor)/distance meter | 53 |
| Parameter memory | 54 |
| Connection | 55 |
| LED maintenance identification | 60 |
| Movable element (e.g. nozzle needle) | 111 |
| Application head | 115 |
| Connecting rod | 122 |
| Lever arm | 130 |
| Rocker suspension | 133 |
| First sub-arm | 136 |
| Inner thread | 136.1 |
| Second sub-arm | 138 |
| Screw nut | 138.1 |
| Screw rod | 138.2 |
| Screw nut thread | 138.3 |
| Screw thread | 138.4 |
| Lock nut thread | 138.5 |
| Lock nut | 138.7 |
| Rocker mounting device | 140 |
| Rocker element | 142 |
| Rocker-element-side O ring seat | 143 |
| Flange | 143.1 |
| First contact surface | 143.2 |
| Second contact surface | 143.3 |
| Longitudinal direction | 144 |
| First mounting point | 146 |
| Second mounting point | 148 |
| First support device | 152 |
| First ball | 153 |
| Second support device | 154 |
| Second ball | 155 |
| First recess | 156 |
| First rocker-element-side ball seat | 157 |
| Second recess | 158 |
| Second rocker-element-side ball seat | 159 |
| Plate element | 160 |
| Opening | 162 |
| First recess | 164 |
| First plate-element-side ball seat | 165 |
| Second recess | 166 |
| Second plate-element-side ball seat | 167 |
| O ring | 168 |
| Sealing device | 170 |
| O ring | 172 |
| Plate-element-side O ring seat | 173 |
| Flange | 173.1 |
| First contact surface | 173.2 |
| Second contact surface | 173.3 |
| Spring element | 180 |
| Spiral spring | 182 |
| Plate-side seat | 184 |
| Sleeve | 186 |
| Flange | 186.1 |
| Lever-arm-side seat | 186.2 |
| Thermal decoupling device | 190 |
| Insulation plate | 192 |
| Cable tensioning device | 194 |
| Spacer/positioning bolt | 196 |
| Positioning bolt | 197 |

-continued

| Reference list | |
|---|---|
| Tensioning cable | 198 |
| Drive-side anchoring | 199.1 |
| Lever-arm-side anchoring | 199.2 |
| Application apparatus | 100 |
| Attachment point | A |
| Paper web | K |
| Flowable medium | M |
| Movement direction | V |
| Virtual axis | VA |
| Opening movement/movement profile | P/P(t, Z) |
| Countermovement/movement profile | P1/P1(t, Z) |
| Movement profile | P1*(t, Z) |
| Parameter | PA, PB, PC, PD |
| Further processed parameters | PA*, PB* |
| Time | t |
| Cycle time | T |
| Axis | Z |

The invention claimed is:

1. A lever arm suspension (133), which is designed for use in an adhesive application head (115), wherein the application head (115) comprises:

a chamber (10) in the interior of the application head (115), a movable element (111), which is mounted movably in the interior of the chamber (10) and which releases an outlet opening through an opening movement (P), a drive (20) for generating the opening movement (P) of the movable element (111), wherein the lever arm suspension is a rocker suspension (133) with: a lever arm (130) which can be connected to the movable element (111) and the drive (20) in order to convert a drive-side movement (PI) into the opening movement (P) of the movable element (111), a plate element (160) having an opening (162) through which the lever arm (130) extends, a rocker mounting device (140) which is designed to connect the lever arm (130) movably to the application head (115) and a sealing device (180) which is configured to prevent any escape of adhesive from the chamber through the opening (162) in the plate element (160), wherein the rocker mounting device (140) comprises:

a rocker element (142) which is rigidly connected to the lever arm (130) and has a longitudinal direction (144) as well as a first (146) and second (148) mounting point, wherein the longitudinal direction (144) extends substantially perpendicular to the lever arm (130) and in a plane parallel to the plate element (160) and wherein the first and the second mounting point (146,148) are disposed spaced apart along the longitudinal direction (144) and a first (152) and a second (154) support device which are disposed on a rocker bearing side of the plate element (160) and are configured to support the first or second mounting point (146,148), wherein the sealing device (180) comprises an O ring (172) which is disposed on the side of the rocker element (142) around the opening (162), wherein the plate element (160) on the side of the rocker element (142) has a plate-element-side O ring seat (173) surrounding the opening (162) and that the rocker element on a side facing the plate element (160) has a corresponding rocker-element-side O ring seat (143), and wherein the plate-element-side O ring seat (173) is configured as a flange (173.1) formed on the rocker-element-side outlet of the opening (162) around the opening (162) having a first contact surface (173.2) parallel to the plate element plane and a cylindrical inner-wall shaped second contact surface (173.2) for an outer circumference of the O ring (172) and that the rocker-element-side O ring seat (143) is configured as a flange (143.1) formed on the side of the rocker element (142) facing the plate element (160) having a first contact surface (143.2) parallel to the plate element plane and a cylindrical outer-wall-shaped second contact surface (143.3) for an inner circumference of the O ring (172).

2. The lever arm suspension (133) according to claim 1, wherein the first and the second support device (152,154) is configured as a first (153) and a second (155) ball, the plate element (160) on a side facing the rocker element comprises a first (164) and a second (166) recess each configured as a plate-element-side ball seat (165,167) and the rocker element on a side facing the plate element (160) comprises a first (156) and a second (158) recess each configured as a rocker-element-side ball seat (157,159).

3. The lever arm suspension (133) according to claim 2, wherein the diameter of each plate-element-side recess (164, 166) is approximately 0.1 mm greater than the diameter of the balls (153, 155) so that the first or second balls (153, 155) in the plate-element-side recess (164, 166) rests on an adhesive film and that the first or second ball (153, 155) is pressed in the first or second rocker-element-side ball seat (157, 159).

4. The lever arm suspension (133) according to claim 2, wherein the diameter of each rocker-element-side recess (156, 158) is approximately 0.1 mm greater than the diameter of the balls (153, 155) so that the first or second balls (153, 155) in the rocker-element-side recess (156, 158) rests on an adhesive film and that the first or second ball (153, 155) is pressed in the first or second plate-element-side ball seat (165, 167).

5. The lever arm suspension (133) according to claim 1, further wherein a spring element (190) which pre-tensions the rocker element (142) in the direction of the plate element (160) and the mounting points (146, 148).

6. The lever arm suspension (133) according to claim 5, wherein the spring element (180) is a spiral spring (182) which is disposed on the side of the plate element (160) opposite the rocker bearing side around the lever arm (130).

7. The lever arm suspension (133) according to claim 5, wherein on the plate element side opposite the rocker bearing side has a plate-side seat (186) for the spring element (180) disposed around the opening (162) and that the lever arm at an outer drive-side end has a lever-arm-side seat (186.2) for the spring element (180) formed as a flange (186.1).

8. The lever arm suspension (133) according to claim 7, wherein the lever arm (130) is formed in two parts and on the rocker bearing side comprises a first sub-arm (136) which can be connected to the movable element (111) and on the side opposite the rocker bearing side comprises a second sub-arm (138) which can be connected to the drive (20).

9. The lever arm suspension (133) according to claim 8, wherein the second sub-arm (138) comprises a screw nut (138.1), a screw rod (138.2) having a screw nut thread (138.3) and a screw thread (138.4) which engages at an outer end in a complementary internal thread (136.1) in the first sub-arm (136) and a sleeve (186) which has the lever-arm-side seat (186.2) for the spring element (180) configured as a flange (186.1) and through which the screw rod (138.2) extends.

10. An adhesive application head (15,115) for dispensing a flowable adhesive (M) comprising: an interior chamber (10), an outlet opening (12), a movable element (11) which is movably mounted in the interior of the chamber (10) wherein the outlet opening (12) can be released or closed by an opening movement (P) of the movable element (11, 111), a supply channel (13) which is fluidically connected to the chamber (10), in order to be able to introduce the flowable adhesive (M) into the chamber (10), a drive (20) for generating the movement (P) of the movable element (11, 111), wherein the adhesive application head (15) comprises a lever arm suspension, the lever arm suspeension comprising a rocker suspension (133) comprising: a lever arm (130) which can be connected to the movable element (111) and the drive (20) in order to convert a drive-side movement (PI) into the opening movement (P) of the movable element (111), a plate element (160) having an opening (162) through which the lever arm (130) extends, a rocker mounting device (140) which is designed to connect the lever arm (130) movably to the application head (115)

a sealing device (180) which is configured to prevent any escape of adhesive from the chamber through the opening (162) in the plate element (160), wherein the rocker mounting device (140) comprises the following: a rocker element (142) which is rigidly connected to the lever arm (130) and has a longitudinal direction (144) as well as a first (146) and second (148) mounting point, wherein the longitudinal direction (144) extends substantially perpendicular to the lever arm (130) and in a plane parallel to the plate element (160) and wherein the first and the second mounting point (146,148) are disposed spaced apart along the longitudinal direction (144), and a first (152) and a second (154) support device which are disposed on a rocker bearing side of the plate element (160) and are configured to support the first or second mounting point (146,148), wherein the sealing device (180) comprises an O ring (172) which is disposed on the side of the rocker element (142) around the opening (162), wherein the plate element (160) on the side of the rocker element (142) has a plate-element-side O ring seat (173) surrounding the opening (162) and that the rocker element on a side facing the plate element (160) has a corresponding rocker-element-side O ring seat (143), wherein the plate-element-side O ring seat (173) is configured as a flange (173.1) formed on the rocker-element-side outlet of the opening (162) around the opening (162) having a first contact surface (173.2) parallel to the plate element plane and a cylindrical inner-wall shaped second contact surface (173.2) for supporting an outer circumference of the O ring (172), and wherein the rocker-element-side O ring seat (143) is configured as a flange (143.1) formed on the side of the rocker element (142) facing the plate element (160) having a first contact surface (143.2) parallel to the plate element plane and a cylindrical outer-wall-shaped second contact surface (143.3) for supporting an inner circumference of the O ring (172).

11. The adhesive application head (115) according to claim 10, wherein the first and the second support device (152,154) is configured as a first (153) and a second (155) ball, the plate element (160) on a side facing the rocker element comprises a first (164) and a second (166) recess each configured as a plate-element-side bail seat (165,167) and the rocker element on a side facing the plate element (160) comprises a first (156) and a second (158) recess each configured as a rocker-element-side ball seat (157,159).

12. The adhesive application head (115) according to claim 10, wherein the diameter of each plate-element-side recess (164, 166) is approximately 0.1 mm greater than the diameter of the balls (153, 155) so that the first or second balls (153, 155) in the plate-element-side recess (164, 166) rests on an adhesive film and that the first or second ball (153, 155) is pressed in the first or second rocker-element-side ball seat (157, 159).

13. The adhesive application head (115) according to claim 10, wherein the diameter of each rocker-element-side recess (156, 158) is approximately 0.1 mm greater than the diameter of the balls (153, 155) so that the first or second balls (153, 155) in the rocker-element-side recess (156, 158) rests on an adhesive film and that the first or second ball (153, 155) is pressed in the first or second plate-element-side ball seat (165,167).

14. The adhesive application head (115) according to claim 10, further wherein a spring element (190) which pre-tensions the rocker element (142) in the direction of the plate element (160) and the mounting points (146, 148).

15. The adhesive application head (115) according to claim 14, wherein the spring element (180) is a spiral spring (182) which is disposed on the side of the plate element (160) opposite the rocker bearing side around the lever arm (130).

16. The adhesive application head (115) according to claim 14, wherein on the plate element side opposite the rocker bearing side has a plate-side seat (186) for the spring element (180) disposed around the opening (162) and that the lever arm at an outer drive-side end has a lever-arm-side seat (186.2) for the spring element (180) formed as a flange (186.1).

17. The adhesive application head (115) according to claim 16, wherein the lever arm (130) is formed in two parts and on the rocker bearing side comprises a first sub-arm (136) which can be connected to the movable element (111) and on the side opposite the rocker bearing side comprises a second sub-arm (138) which can be connected to the drive (20).

18. The adhesive application head (115) according to claim 17, wherein the second sub-arm (138) comprises a screw nut (138.1), a screw rod (138.2) having a screw nut thread (138.3) and a screw thread (138.4) which engages at an outer end in a complementary internal thread (136.1) in the first sub-arm (136) and a sleeve (186) which has the lever-arm-side seat (186.2) for the spring element (180) configured as a flange (186.1) and through which the screw rod (138.2) extends.

19. The adhesive application head (115) according to claim 10 wherein the drive (20) and the lever arm suspension (33, 133) are thermally substantially decoupled from one another by means of a thermal decoupling device (190) and are connected to one another in functional interaction.

20. The adhesive application head (15, 115) according to claim 19, wherein the thermal decoupling device (190) comprises an insulation plate (192) disposed between the drive (20) and the lever arm suspension and at least two cable tensioning devices (194) which each interconnect the drive (20) and the lever arm suspension.

21. The adhesive application head (15,115) according to claim 20, wherein the cable tensioning device (194) comprises a bolt (196) disposed between the drive (20) and the lever arm suspension and a tensioning cable (198) which extends through the bolt (196) and is anchored at one end by a drive-side anchoring (199.1) in the drive (20) and at an other end is anchored in a lever-arm-side anchoring (199.2) in the lever arm suspension.

* * * * *